US011735801B2

(12) United States Patent
Meng

(10) Patent No.: US 11,735,801 B2
(45) **Date of Patent: *Aug. 22, 2023**

(54) HIGH-Q TRIPLE-MODE CAVITY DIELECTRIC RESONANT HOLLOW STRUCTURE AND FILTER WITH RESONANT STRUCTURE

(71) Applicant: HONGKONG FINGU DEVELOPMENT COMPANY LIMITED, Hong Kong (CN)

(72) Inventor: Qingnan Meng, Hubei (CN)

(73) Assignee: HONGKONG FINGU DEVELOPMENT COMPANY LIMITED, Hong Kong (CN)

( * ) Notice: Subject to any disclaimer, the term of this patent is extended or adjusted under 35 U.S.C. 154(b) by 183 days.

This patent is subject to a terminal disclaimer.

(21) Appl. No.: 17/267,509

(22) PCT Filed: Dec. 29, 2018

(86) PCT No.: PCT/CN2018/125165

§ 371 (c)(1),
(2) Date: Feb. 10, 2021

(87) PCT Pub. No.: WO2020/048064

PCT Pub. Date: Mar. 12, 2020

(65) Prior Publication Data

US 2021/0320391 A1 Oct. 14, 2021

(30) Foreign Application Priority Data

Sep. 4, 2018 (CN) ..... 201811026913.5

(51) Int. Cl.

| | |
|---|---|
| ***H01P 7/10*** | (2006.01) |
| ***H01P 1/213*** | (2006.01) |
| ***H01P 7/06*** | (2006.01) |

(52) U.S. Cl.
CPC ..... *H01P 1/2138* (2013.01); *H01P 7/06* (2013.01); *H01P 7/105* (2013.01)

(58) Field of Classification Search
CPC .... H01P 1/2138; H01P 1/2082; H01P 1/2084; H01P 1/2086; H01P 1/208; H01P 7/06; H01P 7/105; H01P 7/00; H01P 7/10
See application file for complete search history.

(56) References Cited

U.S. PATENT DOCUMENTS 11,239,540 B2 * 2/2022 Meng ..... H01P 7/105
11,258,150 B2 * 2/2022 Meng ..... H01P 1/2086
(Continued)

FOREIGN PATENT DOCUMENTS

CN 1269914 A 10/2000
CN 1472842 A 2/2004
(Continued)

OTHER PUBLICATIONS

Zhang, Tongxuan; Zhao, Zhentang; <Design of a cavity filter>; «Nuclear Techniques», Jun. 10, 2008; pp. 401-404; vol. 31, No. 6.
(Continued)

*Primary Examiner* — Stephen E. Jones
(74) *Attorney, Agent, or Firm* — Gang Yu

(57) ABSTRACT

The disclosure provides a high-Q triple-mode cavity dielectric resonant hollow structure and a filter with the dielectric resonant structure. The structure includes a cavity and a cover plate, wherein the cavity is internally provided with a cube-like dielectric resonance block and a dielectric support frame; the cube-like dielectric resonance block and the dielectric support frame form a triple-mode dielectric resonance rod; air is arranged between the triple-mode dielectric resonance rod and an inner wall of the cavity; one end or any end of the cube-like dielectric resonance block is connected with the dielectric support frame respectively; the dielectric
(Continued)

support frame is connected with an inner wall of the cavity; and the cube-like dielectric resonance block forms triple-mode resonance in directions of X, Y and Z-axes of the cavity.

39 Claims, 8 Drawing Sheets

(56) References Cited

U.S. PATENT DOCUMENTS

| | | | | |
|---|---|---|---|---|
| 11,271,279 | B2 * | 3/2022 | Du | H01P 7/105 |
| 2006/0028299 | A1 | 2/2006 | Andoh et al. | |
| 2016/0294030 | A1 | 10/2016 | Kwak et al. | |

FOREIGN PATENT DOCUMENTS

| | | | |
|---|---|---|---|
| CN | 105390780 | A | 3/2016 |
| CN | 106785263 | A | 5/2017 |
| CN | 107069154 | A | 8/2017 |
| CN | 108336458 | A | 7/2018 |
| CN | 207677042 | U | 7/2018 |
| EP | 1014474 | A1 | 6/2000 |
| EP | 1353398 | A2 | 10/2003 |
| EP | 3217469 | A | 9/2017 |

OTHER PUBLICATIONS

Bakr Mustafa S et al: "Miniature Triple-Mode Dielectric Resonator Filters", 2018 IEEE/MTT-S Internation Microwave Symposium—IMS, IEEE, Jun. 10, 2018, pp. 1249-1252, XP033387893.
Corresponding EP search report dated Apr. 29, 2022.

* cited by examiner

Solved Modes Export

| | Eigenmode | Frequency [GHz] | |
|---|---|---|---|
| | Mode 1 | 1.88160 +j 5.30125e-005 | 17746.8 |
| | Mode 2 | 1.88193 +j 5.29487e-005 | 17771.3 |
| | Mode 3 | 1.88256 +j 5.28891e-005 | 17797.2 |
| | Mode 4 | 1.90531 +j 8.92146e-005 | 10678.2 |

Solved Modes Export

| | Eigenmode | Frequency (GHz) | |
|---|---|---|---|
| | Mode 1 | 1.88520 +j 5.34201e-005 | 17645.1 |
| | Mode 2 | 1.88527 +j 5.40126e-005 | 17452.1 |
| | Mode 3 | 1.88534 +j 5.30473e-005 | 17770.4 |
| | Mode 4 | 1.90527 +j 8.92576e-005 | 10672.9 |

Solved Modes Export

| | Eigenmode | Frequency (GHz) | |
|---|---|---|---|
| | Mode 1 | 1.87950 +j 5.42008e-005 | 17338.3 |
| | Mode 2 | 1.88111 +j 5.52704e-005 | 17017.3 |
| | Mode 3 | 1.88120 +j 5.52554e-005 | 17022.8 |
| | Mode 4 | 1.90185 +j 8.97315e-005 | 10597.5 |

Solved Modes Export

| | Eigenmode | Frequency (GHz) | |
|---|---|---|---|
| | Mode 1 | 1.88167 +j 5.33479e-005 | 17635.9 |
| | Mode 2 | 1.88190 +j 5.33107e-005 | 17650.3 |
| | Mode 3 | 1.88232 +j 5.32579e-005 | 17671.7 |
| | Mode 4 | 1.90614 +j 8.90485e-005 | 10702.8 |

HIGH-Q TRIPLE-MODE CAVITY DIELECTRIC RESONANT HOLLOW STRUCTURE AND FILTER WITH RESONANT STRUCTURE

CROSS REFERENCE TO RELATED APPLICATION(S)

The present disclosure is a national stage application of International Patent Application No. PCT/CN2018/125165, which is filed on Dec. 29, 2018 and claims priority to Chinese Patent Priority No. 201811026913.5, filed to the National Intellectual Property Administration, PRC on Sep. 4, 2018, entitled "High-Q Triple-Mode Cavity Dielectric Resonant Hollow Structure and Filter with Resonant Structure", the disclosure of which is hereby incorporated by reference in its entirety.

TECHNICAL FIELD

The disclosure relates to a base station filter, an antenna feeder filter, a combiner, an anti-interference filter and the like used in the field of wireless communications. Types of the filters may be band pass, band stop, high pass and low pass, and the disclosure particularly relates to a high-Q triple-mode cavity dielectric resonant hollow structure and a filter with the high-Q triple-mode cavity dielectric resonant hollow structure.

BACKGROUND

Along with the rapid development of 4G mobile communications to 5G mobile communications, miniaturization and high performance of communication facilities are increasingly highly required. Traditional filters are gradually replaced by single-mode dielectric filters due to large metallic cavity volume and ordinary performance, the single-mode dielectric filters mainly include a Transverse Electric 01 (TE01)-mode dielectric filter and a Transverse Magnetic (TM)-mode dielectric filter, the TE01-mode dielectric filter and the TM-mode dielectric filter generally adopt a single-mode dielectric resonant mode, and the resonant mode increases a certain Q value, but has defects of high manufacturing cost and large volume.

In order to solve technical problems of high cost and large volume of the single-mode dielectric filters, a triple-mode dielectric filter emerges at the right moment. In an art known to inventors, the triple-dielectric filter generally includes a TE triple-mode filter and a TM triple-mode filter. The TE triple-mode filter has the characteristics of being complex in coupling mode, large in volume and high in Q value, and the TM triple-mode filter has the characteristics of being simple in coupling mode, small in volume and low in Q value. With respect to a TE triple-mode filter and a TM triple-mode filter of a same frequency band, the weight, cost and volume of the TM triple-mode filter are greatly smaller than those of the TE triple-mode filter. Therefore, in the art known to inventors, the TE triple-mode filter is generally adopted to design a narrow band filter, and the TM triple-mode filter is generally used as other types of filters. Since a dielectric resonant block of the TM triple-mode filter is coated by baked silver, a vitreous substance is formed between a silver layer after silver baking and a surface of the dielectric resonant block, thus actual conductivity is greatly degraded, the Q value is actually low, and the use range of the TM triple-mode filter is further limited. Therefore, how to obtain a TM triple-mode filter of a small volume and a high Q value is a new direction of research and development of filters.

The TM triple-mode filter known to inventors generally adopts a structure that a cube/cube-like/spherical dielectric resonant block is arranged in a cube/cube-like/spherical resonant cavity, the dielectric resonant block is supported by a dielectric base, and a ratio of a size of a single side of the resonant cavity to a size of a single side of the dielectric resonant block is generally greater than 1.6. When the volume of the resonant cavity is maintained and the volume of the dielectric resonant block is slightly increased, or the volume of the resonant cavity is slightly decreased and the volume of the dielectric resonant block is maintained, or the volume of the resonant cavity is slightly decreased and the volume of the dielectric resonant block is slightly increased, comparison of data provided by Table 1 shows that while the ratio of the size of the single side of the resonant cavity to the size of the single side of the dielectric resonant block is increased, a Q value of a base mode is increased along with increase of the ratio, a Q value of a higher-order mode is decreased along with increase of the ratio, the size of the dielectric resonant block is decreased along with increase of the ratio, the size of a cavity is continuously increased, when the size is approximate to a ¾ wavelength size of the cavity, the size of the dielectric resonant block is continuously decreased, the Q value of the base mode is also decreased, and a frequency of the higher-order mode is approximate to or far away from a frequency of the base mode along with increase of the ratio at times.

Cavity volumes of the resonant cavities corresponding to different ratios are also different and can be selected according to actual demands. Single cavities with a ratio of 1.6 or greater may be selected for cavities of different sizes in a ratio range in Table 1 and corresponding cube resonators when the performance requirement of filters is higher. Therefore, when the ratio of the size of the single side of the resonant cavity to the size of the single side of the dielectric resonant block is greater than 1.6, the Q value is proportional to a distance between the resonant cavity and the dielectric resonant block, but a defect that the volume of a filter is too large is caused.

TABLE 1

| Single cavity side length (mm) | Side length of dielectric resonance block | Q value | Ratio (single cavity side length/side length of resonance block) | Higher-order frequency | Dielectric constant and frequency |
|---|---|---|---|---|---|
| 48 | 23.4 | 30562 | 2.05 | 2327.00 | ER = 35, F: 1880 |
| 46 | 23.54 | 28770 | 1.95 | 2315.00 | ER = 35, F: 1880 |
| 44 | 23.75 | 26683 | 1.85 | 2295.00 | ER = 35, F: 1880 |
| 42 | 24.04 | 24308 | 1.75 | 2264.00 | ER = 35, F: 1880 |
| 40 | 24.4 | 21686 | 1.64 | 2224.00 | ER = 35, F: 1880 |
| 38 | 24.9 | 18783 | 1.53 | 2172.00 | ER = 35 F: 1880 |
| 36 | 25.7 | 15496 | 1.40 | 2081.00 | ER = 35, F: 1880 |

SUMMARY

In light of defects of an art known to inventors, the disclosure aims to solve the technical problem of providing a high-Q triple-mode cavity dielectric resonant hollow structure and a filter with the structure, and the structure is capable of reducing overall insertion loss of the filter to meet requirements of a cavity filter on small inserts and smaller volume.

An embodiment of the disclosure discloses a high-Q triple-mode cavity dielectric resonant hollow structure used in a filter. The high-Q triple-mode cavity dielectric resonant hollow structure used in the filter includes cavity and a cover plate, wherein the cavity is internally provided with a dielectric resonant block and a dielectric support frame; the cavity takes a cube-like shape; the dielectric resonant block is internally provided with a hollow chamber; the dielectric support frame is connected with the dielectric resonant block and an inner wall of the cavity, respectively; the dielectric resonant block and the dielectric support frame form a triple-mode dielectric resonator; a dielectric constant of the dielectric support frame is smaller than a dielectric constant of the dielectric resonant block;

a ratio K of a size of a single side of the inner wall of the cavity to a size of a corresponding single side of the dielectric resonant block is: K is greater than or equal to a transition point 1 and is smaller than or equal to a transition point 2, a Q value of a higher-order mode adjacent to a base mode of a triple-mode cavity resonant structure is transited into a Q value of the base mode of the triple-mode cavity resonant structure, a base-mode resonant frequency after transition is equal to a base-mode resonant frequency prior to transition, a Q value of the base mode after transition is greater than a Q value of the base mode prior to transition, and a Q value of the higher-order mode adjacent to the base mode after transition is smaller than a Q value of the higher-order mode adjacent to the base mode prior to transition; the triple-mode dielectric resonant structure is internally provided with a coupling structure for changing an orthogonal property of an electromagnetic field of a degenerate triple-mode in the cavity; and the triple-mode dielectric resonant structure is internally provided with a frequency tuning device for changing a tuning frequency of the degenerate triple-mode in the cavity.

In an exemplary embodiment of the disclosure, the hollow chamber is of a cube-like shape; when a ratio of size of the single side of the dielectric resonant block to a size of a corresponding single side of the hollow chamber is greater than 6, the transited Q value of the base mode remains generally unchanged, and when the ratio of the single side of the dielectric resonant block to the size of the corresponding single side of the hollow chamber is smaller than 6, the transited Q value of the base mode is greatly decreased.

In an exemplary embodiment of the disclosure, the hollow chamber is of a cylinder-like shape or a sphere-like shape; when a ratio of the size of the single side of the dielectric resonant block to a size of a diameter of the hollow chamber is greater than 6, the transited Q value of the base mode remains unchanged; and when the ratio of the single side of the dielectric resonant block to a size of a corresponding single side of the hollow chamber is smaller than or equal to 6, the transited Q value of the base mode is greatly decreased.

In an exemplary embodiment of the disclosure, a nested dielectric resonant block is nested in the hollow chamber; a volume of the nested dielectric resonant block is smaller than or equal to a volume of the hollow chamber; when the volume of the nested dielectric resonant block is smaller than the volume of the hollow chamber, the nested dielectric resonant block is installed in the hollow chamber through the dielectric support frame in a supported manner; the nested dielectric resonant block is of a solid structure or hollow structure; the nested dielectric resonant block of the hollow structure is filed with air or a second nested dielectric resonant block is nested therein, and so on.

In an exemplary embodiment of the disclosure, both the hollow chamber and the nested dielectric resonant block take a cube-like shape; when the ratio of the size of the single side of the hollow chamber to the size of a corresponding single side of the nested dielectric resonant block is smaller than or equal to 2, the transited Q value of the base mode remains substantially unchanged; and when the ratio of the single side of the dielectric resonant block to the size of the corresponding single side of the hollow cavity is greater than 2, the transited Q value of the base mode is greatly decreased.

In an exemplary embodiment of the disclosure, both the hollow chamber and the nested dielectric resonant block take a cylinder-like shape or a sphere-like shape; when the ratio of a diameter of the hollow chamber to a diameter of the nested dielectric resonant block is smaller than or equal to 2, the transited Q value of the base mode remains substantially unchanged, and when the ratio of the diameter of the hollow chamber to the diameter of the nested dielectric resonant block is greater than 2, the transited Q value of the base mode is greatly decreased.

In an exemplary embodiment of the disclosure, a value of the transition point 1 and a value of the transition point 2 both vary according to different base-mode resonant frequencies of the dielectric resonant structure, dielectric constants of the dielectric resonant block and dielectric constants of the support frame.

In an exemplary embodiment of the disclosure, when the base-mode resonant frequency of the dielectric resonant structure after transition remains unchanged, the Q value of the triple-mode cavity resonant structure is relevant to the K value, the dielectric constant of the dielectric resonant block and the size of the dielectric resonant block.

In an exemplary embodiment of the disclosure, when the K value is increased to the maximum from 1.0, the K value has three Q value transition points within a variation range, each Q value transition point enables the Q value of the base mode and the Q value of the higher-order mode adjacent to the base mode to be transited; When the Q value of the higher-order mode adjacent to the base mode is transited into the Q value of the base mode, the Q value is increased when being compared with that prior to transition.

In an exemplary embodiment of the disclosure, in four areas formed by a start point and a final point of the K value and the three value Q transition points, the Q value of the base mode and the Q value of the higher-order mode adjacent to the base mode vary along with variation of cavity sizes and dielectric resonant blocks sizes, and different areas have different requirements when being applied to a filter.

In an exemplary embodiment of the disclosure, 1.03<the value of the transition point 1<1.25, 1.03<the value of the transition point 2<1.25, the value of the transition point 1<the value of the transition point 2.

In an exemplary embodiment of the disclosure, the coupling structure is arranged on the dielectric resonant block, and the coupling structure at least includes two nonparallel arranged holes and/or grooves and/or cut corners and/or chamfers.

In an exemplary embodiment of the disclosure, the grooves or the cut corners or the chamfers are arranged on edges of the dielectric resonant block.

In an exemplary embodiment of the disclosure, the holes or grooves are arranged on an end face of the dielectric resonant block, central lines of the holes or grooves are parallel to edges perpendicular to the end surfaces with the holes or the grooves of the dielectric resonant block.

In an exemplary embodiment of the disclosure, the coupling structure is arranged on the cavity, and the coupling structure at least includes two nonparallel arranged chamfers and/or bosses arranged at inner corners of the cavity and/or tapping lines/pieces arranged in the cavity and do not contact with the dielectric resonant block.

In an exemplary embodiment of the disclosure, a frequency tuning device includes a tuning screw arranged on the cavity and/or a film arranged on the surface of the dielectric resonant block and/or a film arranged on the inner wall of the cavity and/or a film arranged on the inner wall of the cover plate.

In an exemplary embodiment of the disclosure, at least one dielectric support frame is arranged on at least one end face of the dielectric resonant block.

The disclosure also discloses a filter with the high-Q triple-mode cavity dielectric resonant hollow structure. The filter includes a cavity, a cover plate and an input/output structure, and the cavity is at least internally provided with one high-Q triple-mode cavity dielectric resonant hollow structure.

In an exemplary embodiment of the disclosure, the high-Q triple-mode cavity dielectric resonant hollow structure is combined with a single-mode resonant structure, a dual-mode resonant structure and a triple-mode resonant structure in different modes to form filters of different volumes; a coupling of any two resonant cavities formed by permutation and combination of the High-Q triple-mode cavity dielectric resonant structure and any one of the single-mode resonant structure, the dual-mode resonant structure and the triple-mode resonant structure is achieved through a size of a window between the two resonant cavities necessarily when resonators in the two resonant cavities are parallel, and the size of the window is determined according to a coupling amount; and the filter has function properties of band pass, band stop, high pass, low pass and a duplexer, a multiplexer and a combiner formed thereby.

In an exemplary embodiment of the disclosure, when the tuning frequency of the high-Q triple-mode cavity dielectric resonant hollow structure remains unchanged, a triple-mode Q value is relevant to the ratio K of the side length of the inner wall of the cavity to the side length of the dielectric resonant block, the dielectric constant of the dielectric resonant block and a size variation range of the dielectric resonant block, and the range of the K value is relevant to different resonant frequencies and dielectric constants of the dielectric resonant block and the dielectric support frame.

In the above technical solution, the variation range of the ratio K of the side length of the inner wall of the cavity in the high-Q triple-mode cavity dielectric resonant hollow structure to the size of the dielectric resonant block is that when the K value is increased to the maximum from 1.0, the K value has three Q value transition points within the variation range, each transition point enables the Q value of the base-mode resonant frequency to be transited into the Q value of an adjacent higher-order mode resonant frequency, and when an adjacent Q value of the higher-order mode is transited into the Q value of the base mode, the Q value of the base mode and the Q value of the higher-order mode are increased when being compared with that prior to transition (i.e. both the Q value of the base mode and the Q value of the higher-order mode increase with increasing the K value.).

In an exemplary embodiment, in four areas formed by the start point and the final point of the K value and the three value Q transition points, the Q value of the base mode and the adjacent Q value of the higher-order mode gradually vary along with variation of cavity sizes and dielectric resonant block sizes, and different areas have different requirements when being applied to the filter (application in different areas is explained in the description and examples).

In an exemplary embodiment, the dielectric resonant block of the disclosure is of a solid structure of a cube-like shape, the cube-like shape is defined as that the dielectric resonant block is a cuboid or cube, when the dielectric resonant block has a same size in X, Y and Z axes, a degenerate triple mode is formed, and the degenerate triple-mode is coupled with other single cavities to form a passband filter; when differences of sizes in three directions along the X, Y and Z axes are slightly unequal, orthogonal-like triple-mode resonant is formed, if an orthogonal-like triple-mode is capable of coupling with other cavities into the passband filter, the sizes are acceptable, and if the orthogonal-like triple-mode cannot be coupled with other cavities into the passband filter, the sizes are unacceptable; and when the differences of the sizes in the three directions along the X, Y and Z axes are greatly different, the degenerate triple-mode or orthogonal-like triple-mode cannot be formed, three modes of different frequencies are formed instead, thus the modes cannot be coupled with other cavities into the passband filter, and the sizes are unacceptable.

In an exemplary embodiment, the high-Q triple-mode cavity dielectric resonant hollow structure is internally provided with at least two nonparallel arranged coupling devices for changing the orthogonal property of a degenerate triple-mode electromagnetic field in the cavity, each of the coupling devices includes cut corners and/or holes arranged beside edges of the dielectric resonant block, or includes chamfers and/or cut corners arranged beside the edges of the cavity, or includes cut corners and/or holes arranged beside the edges of the dielectric resonant block, and chamfers/cut corners arranged besides the edges of the cavity, or includes tapping lines or/pieces arranged on nonparallel planes in the cavity, the cut corners take a shape of a triangular prism, a cuboid or a sector, the holes take a shape of a circle, a rectangle or a polygon. After corner cutting or hole formation, in case of frequency holding, side lengths of the dielectric resonant block are increased, and the Q value is slightly decreased; depths of the cut corners or holes are of through or partial cut corners/partial hole structures according to required coupling amounts; the coupling amounts are affected by the sizes of the cut corners/chamfers/holes; the coupling device includes a coupling screw arranged in a direction perpendicular or parallel to the cut corners and/or a direction parallel to the holes; the coupling screw is made of a metal, or the coupling screw is made of a metal and the metal is electroplated by copper or electroplated by silver, or the coupling screw is made of a dielectric, or the coupling screw is made of a surface metallized medium; the coupling screw takes a shape of any one of metallic rods, medium rods, metallic discs, medium discs, metallic rods with metallic discs, metallic rods with medium discs, medium discs with metallic discs and medium rods with medium discs.

In an exemplary embodiment, the high-Q triple-mode cavity dielectric resonant hollow structure forms the degenerate triple-mode in directions along the X, Y and Z axes, and a tuning frequency of the degenerate triple-mode in the direction of an X axis is achieved by additionally installing a tuning screw or a tuning disc at a place with concentrated field intensity on one or two faces of the X axis corresponding to the cavity so as to change a distance or change capacitance; a tuning frequency in the direction of a Y axis is achieved by additionally installing a tuning screw or a tuning disc at a place with concentrated field intensity on one or two faces of the Y axis corresponding to the cavity so as to change a distance or change capacitance; a tuning frequency in the direction of a Z axis is achieved by additionally installing a tuning screw or a tuning disc at a place with concentrated field intensity on one or two faces of the Z axis corresponding to the cavity so as to change a distance or change capacitance; dielectric constant films of different shapes and thicknesses are adhered to a surface of the dielectric resonant block, the inner wall of the cavity or cover plate and the bottom of the tuning screw, and the films are made of a ceramic medium or a ferroelectric material, and frequencies are adjusted by changing dielectric constants; the tuning screw or the tuning disc is made of a metal, or the tuning screw or the tuning disc is made of a metal and the metal is electroplated by copper or electroplated by silver, or the tuning disc or the tuning disc is made of a medium, or the tuning screw or the tuning disc is made of a surface metallized medium; the tuning screw takes a shape of any one of metallic rods, medium rods, metallic discs, medium discs, metallic rods with metallic discs, metallic rods with medium discs, medium discs with metallic discs and medium rods with medium discs; a frequency temperature coefficient of the dielectric resonant block that takes the cube-like shape is controlled by adjusting proportions of medium materials, and is compensated according to frequency deviation variation of the filter at different temperatures; and when the dielectric support frame is fixed with the inner wall of the cavity, in order to avoid stress caused by the cavity and the medium materials in a sudden temperature variation environment, an elastomer for transition is adopted therebetween, so that reliability risks caused by expansion coefficients of materials is buffered.

In an exemplary embodiment, the high-Q triple-mode cavity dielectric resonant hollow structure includes the cavity, the dielectric resonant block and the support frame; when the cavity takes the cube-like shape, a single cube-like dielectric resonant block and the dielectric support frame are installed in any one axial direction of the cavity, and a center of the dielectric resonant block coincides with or approaches to a center of the cavity. An approximate air dielectric support frame supports with any one single face of a cube-like dielectric block, or supports with six faces, or supports with different combinations of two different faces, three faces, four faces and five faces, the dielectric support frame on each face is one or more dielectric support frames, and one or more support frames are installed on different faces according to demands. A support frame of which the dielectric constant is greater than a dielectric constant of air and smaller than a dielectric constant of the dielectric resonant block supports with any one single face of the cube-like dielectric block, or supports with six faces, or supports with different combinations of two different faces, three faces, four faces and five faces; a face without the support frame is air; the air face is arbitrarily combined with the dielectric support frame; the dielectric support frame on each face is one or more dielectric support frames, or is a complex dielectric constant support frame composed of multiple layers of different dielectric constant medium materials; single-layer and multi-layer medium material support frames are arbitrarily combined with cube-like medium blocks; one or more support frames are installed on different faces according to demands; on faces with the support frames, to hold the triple-mode frequencies and the Q value, the size corresponding to the axial direction of the dielectric resonant block of the dielectric support frame is slightly reduced; a single face support combination supports any one face of the dielectric resonant block, and particularly an under surface or bearing surface in a vertical direction; a support combination of two faces includes parallel faces such as upper and lower faces, front and rear faces and left and right faces, and also includes nonparallel faces such as upper and front faces, upper and rear faces, upper and left faces and upper and right faces; a support combination of three faces includes three faces perpendicular to one another, or two parallel faces and one nonparallel face; a support combination of four faces includes two pairs of parallel faces or a pair of parallel faces and two another nonparallel faces; a support combination of five faces includes support structures of other faces except any one face of a front face/a rear face/a left face/a right face/an upper face/a lower face; and a support combination of six faces includes support structures of all faces of a front face/a rear face/a left face/a right face/an upper face/a lower face.

In an exemplary embodiment, any end of the cube-like dielectric resonant block and the dielectric support frame are connected in a mode of crimping, adhesion or sintering; connection is one face connection or combined connection of different faces; multi-layer dielectric support frames are fixed in modes of adhesion, sintering, crimping and the like; the dielectric support frame and the inner wall of the cavity are connected in a mode of adhesion, crimping, welding, sintering or screw fixation; a radio frequency channel formed by coupling of radio frequency signals in directions of the X, Y and Z axes of the triple mode causes loss and generates heat, the dielectric resonant block is sufficiently connected with the inner wall of the cavity through the dielectric support frame, and thus the heat is conducted into the cavity for heat dissipation.

In an exemplary embodiment, the cube-like dielectric resonant block has a single dielectric constant or composite dielectric constants; the dielectric resonant block with the composite dielectric constants is formed by at least two materials of different dielectric constants; the materials of different dielectric constants are combined up and down, left and right, asymmetrically or in a nested mode; when the materials of different dielectric constants are nested in the dielectric resonant block, one or more layers are nested; and the dielectric resonant block with the composite dielectric constants needs to comply with variation rules of the Q value transition points. When the dielectric resonator is subjected to cut side coupling among triple modes, to hold the required frequency, corresponding side lengths of two faces adjacent to the cut sides are adjusted. The dielectric resonant block is made of a ceramic or medium material, and medium sheets of different thicknesses and different dielectric constants are added on the surface of the dielectric resonant block.

In an exemplary embodiment, the dielectric constant of the dielectric support frame is similar to the air dielectric constant, or the dielectric constant of the support frame is greater than the air dielectric constant or smaller than the dielectric constant of the dielectric resonant block; the surface area of the dielectric support frame is smaller than or equal to that of the dielectric resonant block; and the dielectric support frame takes a shape of a cylinder, a cube or a cuboid. The dielectric support frame is of a solid structure or hollow structure, the dielectric support frame of the hollow structure includes a single hole or multiple holes, the hole takes a shape of a circle, a square, a polygon and an arc; the dielectric support frame is made of air, plastics, ceramics and mediums; the dielectric support frame is connected with the dielectric resonant block; when the dielectric constant of the dielectric support is similar to the air dielectric constant, the dielectric support has no effect on the three-mode resonant frequency, when the dielectric constant of the dielectric support frame is greater than the air dielectric constant and smaller than the dielectric constant of the dielectric resonant block, in order to hold original triple-mode frequencies, the size corresponding to the axial direction of the dielectric resonant block of the dielectric support frame is slightly reduced; a support frame with a dielectric constant similar to that of air and a support frame with a dielectric constant smaller than that of the dielectric resonant block are combined and installed in different directions and different corresponding faces of the dielectric resonant block; and when the two support frames of different dielectric constants are combined for use, an axial direction size greater than that of a dielectric resonant block corresponding to an air support frame is slightly reduced on an original basis.

In an exemplary embodiment, the cavity takes the cube-like shape; to achieve coupling of three modes, on premise that the size of the dielectric resonant block is not changed, cut sides for achieving coupling of the three modes are processed on any two adjacent faces of the cavity; the sizes of the cut sides are relevant to required coupling amounts; coupling of two of the three modes is achieved through the cut sides of the cube-like; other coupling is achieved through cut corners of two adjacent sides of the cavity; walls are not broken when corners of the adjacent sides of the cavity are cut; and cut corner faces are completely sealed with the cavity. The cavity is made of a metal or a nonmetal material, the surface of the metal and the nonmetal material is electroplated by copper or silver, and when the cavity is made of the nonmetal material, the inner wall of the cavity needs to be electroplated by a conductive material such as copper or silver, such as plastics and composite materials electroplated by copper or silver.

In an exemplary embodiment, the high-Q triple-mode cavity dielectric resonant hollow structure is combined with a single-mode resonant structure, a dual-mode resonant structure and a triple-mode resonant structure in different modes to form filters of different volumes; coupling of any two resonant cavities formed by permutation and combination of the high-Q triple-mode dielectric resonant structure, the single-mode resonant structure, the dual-mode resonant structure and the triple-mode resonant structure is achieved through a size of a window between the two resonant cavities necessarily when resonators in the two resonant cavities are parallel, and the size of the window is determined according to a coupling amount; and the filter has function properties of band pass, band stop, high pass, low pass and a duplexer, a multiplexer and a combiner formed thereby.

The dielectric constant of the cube-like dielectric resonant block of some embodiments in the disclosure is greater than the dielectric constant of the support frame; when the ratio of the size of the single side of the inner wall of the cavity to the size of the single side of the dielectric resonant block is within 1.03-1.30, the Q value of the higher-order mode is transited into the Q value of the base mode, a triple-mode dielectric Q value of the base mode is increased and the Q value of the higher-order mode is decreased, and compared with single mode and triple-mode dielectric filters known to inventors with same volumes and frequencies, the Q value is increased by 30% or greater; the triple-mode cavity structure is combined with single cavities of different types, for example, the triple-mode cavity structure is combined with a cavity single mode, the triple-mode is combined with the TM mode and the triple-mode is combined with the TE single mode, the greater the number of triple-modes in the filter is, the smaller the volume of the filter is, and the smaller the insertion loss is; the high-Q triple-mode cavity resonant structure generates triple-mode resonant in directions of the X, Y and Z axes, and triple-mode resonant is generated in the directions of the X, Y and Z axes.

When the ratio of the side length of the inner wall of the cavity to the size of a corresponding side length of the dielectric resonant block is within 1.0 to the transition point 1 transited from the Q value, and when the ratio of 1.0, the cavity has a pure medium Q value, when the size of the cavity is increased, the Q value is continuously increased on the basis of a pure medium, the Q value of the higher-order mode is greater than the Q value of the base mode, and when the ratio is increased to the transition point 1, an original Q value of the higher-order mode is approximated to a new Q value of the base mode.

After entering into the transition point 1, in case that the base-mode resonant frequency is maintained, the Q value of the base mode is greater than the Q value of the higher-order mode. Along with increase of the ratio, the sizes of the dielectric block and the cavity are both increased, the Q value of the base mode is also increased, and the Q value of the higher-order mode is also increased; when the ratio is approximate to the transition point 2 of Q value transition, the Q value of the base mode is the highest, between the transition point 1 transited from the Q value of the base mode and the transition point 2 transited from the Q value of the base mode, the frequency of the higher-order mode is approximate to or far away from the frequency of the base mode along with variation of the ratio of the cavity to the dielectric resonant block between the transition point 1 and the transition point 2 at times.

After entering the transition point 2, the Q value of the base mode is smaller than the Q value of the higher-order mode; along with increase of the ratio, the size of the dielectric resonant block is reduced, the size of the cavity is increased, the Q value of the base mode is constantly increased, and when the ratio is approximate to a transition point 3, the Q value of the base mode is approximate to the Q value at the transition point 2.

When the ratio enters the transition point 3, the Q value of the base mode is increased along with increase of the ratio, the Q value of the higher-order mode is decreased along with increase of the ratio, the size of the dielectric resonant block is decreased along with increase of the ratio, and the size of the cavity is constantly increased; when the size is approximate to a ¾ wavelength size of the cavity, the size of the dielectric resonant block is constantly decreased, the Q value of the base mode is also decreased, and the frequency of the higher-order mode is approximate to or far away from the frequency of the base mode along with increase of the ratio at times. A particular ratio of the size of the transition points is relevant to dielectric constants and frequencies of the dielectric resonant block and single or composite dielectric constants of the dielectric resonant block.

The side length of the inner wall of the cavity and the side length of the dielectric resonant block may be or may be not equal in three directions of the X, Y and Z axes. The triple mode is formed when the sizes of the cavity and the cube-like dielectric resonant block are equal in the X, Y and Z axes; size differences in three directions of the X, Y and Z axes may also be slightly unequal; when the sizes of single sides of the cavity in one direction of the X, Y and Z axes and the corresponding dielectric resonant block is different from the sizes of single sides in other two directions of the X, Y and Z axes, or any one of the sizes of symmetric single sides of the cavity and the dielectric resonant block are also different from the sizes of single sides in the other two directions, the frequency of one of the triple modes varies and is different from frequencies of the other two modes of the triple modes, and the larger the size difference is, the larger the difference of the frequency of one mode from those of the other two modes is; when the size in one direction is greater than the sizes in the other two directions, the frequency is decreased on an original basis; when the size in one direction is smaller than those in the other two directions, the frequency is increased on the original basis, and the triple mode is gradually transited into a dual-mode or single mode; if the sizes of the cavity and the resonant block in three axial directions are greatly different, and when the sizes of symmetric single sides in three directions of the X, Y and Z axes are different, frequencies of three modes of the triple modes are different; when the sizes of side lengths in three directions are greatly different, the base mode is a single mode; and when the sizes of the side lengths in three directions are not greatly different, the frequencies are not greatly different, and although the frequencies vary, a triple-mode state may also be maintained through the tuning device.

Coupling of triple modes is achieved through at least two nonparallel arranged coupling devices for changing the orthogonal property of the degenerate triple-mode electromagnetic field in the cavity in the high-Q triple-mode cavity resonant structure of the cavity, the coupling devices include cut corners and/or holes arranged beside the edges of the dielectric resonant block, or include chamfers and/or cut corners arranged beside the edges of the cavity, or include cut corners and/or holes arranged beside the edges of the dielectric resonant block, and chamfers/cur corners beside the edges of the cavity, or include tapping lines or/pieces arranged on nonparallel planes in the cavity, the cut corners take the shape of the triangular prism, the cuboid or the sector, the holes take the shape of the circle, the rectangle or the polygon. After corners are cut or holes are formed, in case of frequency maintenance, side lengths of the dielectric resonant block are increased, and the Q value is slightly decreased. Depths of the cut corners or holes are of through or partial cut corners/partial hole structures according to required coupling amounts, and the coupling amounts are affected by the sizes of the cut corners/chamfers/holes. The coupling device includes a coupling screw disposed in a direction perpendicular or parallel to the cut corners and/or a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; the coupling screw takes a shape of any one of metallic rods, medium rods, metallic discs, medium discs, metallic rods with metallic discs, metallic rods with medium discs, medium rods with metallic discs and medium rods with medium discs.

The tuning frequency of the triple mode in the direction of the X axis is achieved by installing the tuning screw or the tuning disc at the place with concentrated field intensity on one or two faces of the cavity corresponding to the X axis so as to change the distance or change capacitance; the tuning frequency in the direction of the Y axis is achieved by additionally installing the tuning screw or the tuning disc at the place with concentrated field intensity on one or two faces of the Y axis corresponding to the cavity so as to change the distance or change capacitance; and the tuning frequency in the direction of the Z axis is achieved by additionally installing the tuning screw or the tuning disc at the place with concentrated field intensity on one or two faces of the Z axis corresponding to the cavity so as to change the distance or change capacitance.

The triple-mode structure with Q value transition of the dielectric resonant is arbitrarily arranged and combined with the single-mode resonant structure, the dual-mode resonant structure and the triple-mode resonant structure in different modes to form required filters of different sizes; the filter has function properties of band pass, band stop, high pass, low pass and the duplexer, the multiplexer formed between them; and coupling of any two resonant cavities formed by permutation and combination of the single-mode resonant structure, the dual-mode resonant structure and the triple-mode resonant structure is achieved through the size of the window between the two resonant cavities necessarily when resonant rods in two resonant structures are parallel.

Some embodiments of the disclosure have the beneficial effects that the structure is simple in structure and convenient to use; by setting the ratio of the size of the single side of the inner wall of a metallic cavity of a dielectric multiple mode to the size of the single side of the dielectric resonant block within 1.01-1.30, the resonant block is matched with the cavity to form the multiple-mode structure while reverse turning of specific parameters is achieved, and thus a high Q value is ensured when the resonant block and the cavity are at a small distance apart. Furthermore, some embodiments disclose a filter with the high-Q triple-mode cavity resonant structure, and compared with a triple-mode filter known to inventors, the filter has insertion loss reduced by 30% or greater on premise of same frequencies and same volumes. Dielectric resonant frequency transition triple-mode structures formed by the cube-like dielectric resonant block, the dielectric support frame and the cover plate of the cavity of the disclosure have magnetic fields orthogonal to and perpendicular to one another in directions of the X, Y and Z axes, thus three non-interfering resonant modes are formed, a higher-order mode frequency is transited into a high Q value base-mode frequency, coupling is formed among three magnetic fields, and different bandwidth demands of the filters are met by adjusting coupling intensity. When two filters with the High-Q triple-mode cavity resonant structure are used in a typical 1800 MHz frequency filter, a volume equivalent to six single cavities of an original cavity is achieved, the volume may be reduced by 40% on the basis of an original cavity filter, and the insertion loss may also be reduced by about 30%. Since the volume is greatly reduced, and the processing time and electroplating areas are correspondingly reduced, the cost is still equivalent to that of the cavity although the dielectric resonant block is used, if the material cost of the dielectric resonant block is greatly reduced, the design may have obvious cost advantages, when the filter has multiple cavities, three triple-mode structure may be used, and volume and performance may be obviously improved.

Figure 1:
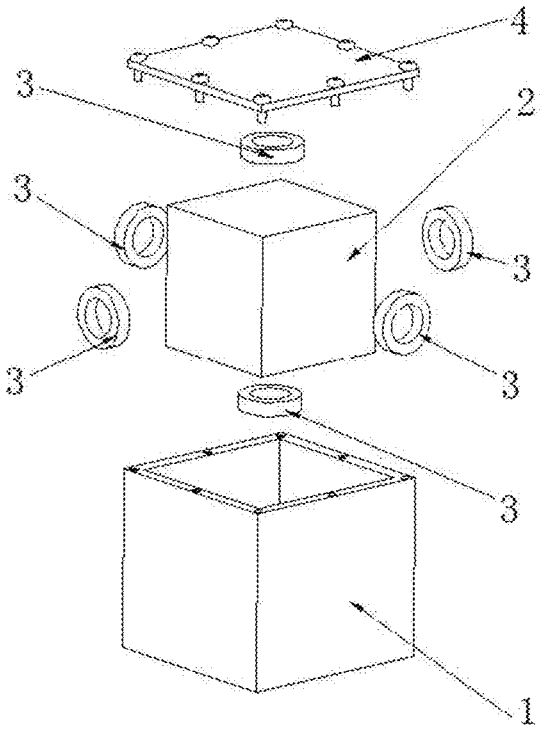
FIG. 1 shows an assembly drawing of a high-Q triple-mode cavity dielectric resonant hollow structure with multiple dielectric support frames.

In the figures: 1—cavity; 2—dielectric resonant block; 3—dielectric support frame; 4—cover plate; 5—coupling of multiple modes; 6—input/output; 7—tuning screw; 8—multi-mode coupling screw; 9—transverse window between multi-mode and metallic rod; 10—nested dielectric resonant block.

DETAILED DESCRIPTION OF THE EMBODIMENTS

To understand the disclosure clearly, the disclosure is specifically described with specific embodiments and figures, and the description does not constitute any limitation to the disclosure. In order to highlight contents of the disclosure, common technologies in cavities such as tuning screws, coupling screws, fly rods, fly rod bases, screw nut fixation and fixation and installation modes of dielectric resonant blocks, such as modes of adhesion, welding, burning connection and pressure welding, are not repeated herein.

An embodiment of the disclosure discloses a high-Q triple-mode cavity dielectric resonant hollow structure used in a filter. The high-Q triple-mode cavity dielectric resonant hollow structure used in the filter includes cavity and a cover plate, wherein the cavity is internally provided with a dielectric resonant block and a dielectric support frame; the cavity takes a cube-like shape: the dielectric resonant block is internally provided with a hollow chamber; the dielectric support frame is connected with the dielectric resonant block and an inner wall of the cavity, respectively; the dielectric resonant block and the dielectric support frame form a triple-mode dielectric resonant rod; a dielectric constant of the dielectric support frame is smaller than a dielectric constant of the dielectric resonant block;

a ratio K of a size of a single side of the inner wall of the cavity to a size of a corresponding single side of the dielectric resonant block is: K is greater than or equal to a transition point 1 and is smaller than or equal to a transition point 2, a Q value of a higher-order mode adjacent to a base mode of a triple-mode cavity resonant structure is transited into a Q value of the base mode of the triple-mode cavity resonant structure, a base-mode resonant frequency after transition is equal to a base-mode resonant frequency prior to transition, a Q value of the base mode after transition is greater than a Q value of the base mode prior to transition, and a Q value of the higher-order mode adjacent to the base mode after transition is smaller than a Q value of the higher-order mode adjacent to the base mode prior to transition; the triple-mode dielectric resonant structure is internally provided with a coupling structure for changing an orthogonal property of an electromagnetic field of a degenerate triple-mode in the cavity; and the triple-mode dielectric resonant structure is internally provided with a frequency tuning device for changing a tuning frequency of the degenerate triple-mode in the cavity.

In an exemplary embodiment of the disclosure, the hollow chamber is of a cube-like shape; when a ratio of size of the single side of the dielectric resonant block to a size of a corresponding single side of the hollow chamber is greater than 6, the transited Q value of the base mode remains generally unchanged, and when the ratio of the single side of the dielectric resonant block to the size of the corresponding single side of the hollow chamber is smaller than 6, the transited Q value of the base mode is greatly decreased.

In an exemplary embodiment of the disclosure, the hollow chamber is of a cylinder-like shape or a sphere-like shape; when a ratio of the size of the single side of the dielectric resonant block to a size of a diameter of the hollow chamber is greater than 6, the transited Q value of the base mode remains unchanged; and when the ratio of the single side of the dielectric resonant block to a size of a corresponding single side of the hollow chamber is smaller than or equal to 6, the transited Q value of the base mode is greatly decreased.

In an exemplary embodiment of the disclosure, a nested dielectric resonant block is nested in the hollow chamber; a volume of the nested dielectric resonant block is smaller than or equal to a volume of the hollow chamber; when the volume of the nested dielectric resonant block is smaller than the volume of the hollow chamber, the nested dielectric resonant block is installed in the hollow chamber through the dielectric support frame in a supported manner; the nested dielectric resonant block is of a solid structure or hollow structure; the nested dielectric resonant block of the hollow structure is filed with air or a second nested dielectric resonant block is nested therein, and so on.

In an exemplary embodiment of the disclosure, both the hollow chamber and the nested dielectric resonant block take a cube-like shape; when the ratio of the size of the single side of the hollow chamber to the size of a corresponding single side of the nested dielectric resonant block is smaller than or equal to 2, the transited Q value of the base mode remains substantially unchanged; and when the ratio of the single side of the dielectric resonant block to the size of the corresponding single side of the hollow cavity is greater than 2, the transited Q value of the base mode is greatly decreased.

In an exemplary embodiment of the disclosure, both the hollow chamber and the nested dielectric resonant block take a cylinder-like shape or a sphere-like shape; when the ratio of a diameter of the hollow chamber to a diameter of the nested dielectric resonant block is smaller than or equal to 2, the transited Q value of the base mode remains substantially unchanged, and when the ratio of the diameter of the hollow chamber to the diameter of the nested dielectric resonant block is greater than 2, the transited Q value of the base mode is greatly decreased.

In an exemplary embodiment of the disclosure, a value of the transition point 1 and a value of the transition point 2 both vary according to different base-mode resonant frequencies of the dielectric resonant block, dielectric constants of the dielectric resonant block and dielectric constants of the support frame.

In an exemplary embodiment of the disclosure, when the base-mode resonant frequency of the dielectric resonant block after transition remains unchanged, the Q value of the triple-mode cavity resonant structure is relevant to the K value, the dielectric constant of the dielectric resonant block and the size of the dielectric resonant block.

In an exemplary embodiment of the disclosure, when the K value is increased to the maximum from 1.0, the K value has three Q value transition points within a variation range, each Q value transition point enables the Q value of the base mode and the Q value of the higher-order mode adjacent to the base mode to be transited; When the Q value of the higher-order mode adjacent to the base mode is transited into the Q value of the base mode, the Q value is increased when being compared with that prior to transition.

In an exemplary embodiment of the disclosure, in four areas formed by a start point and a final point of the K value and the three value Q transition points, the Q value of the base mode and the Q value of the higher-order mode adjacent to the base mode vary along with variation of cavity sizes and dielectric resonant rod sizes, and different areas have different requirements when being applied to a filter.

In an exemplary embodiment of the disclosure, 1.03<the value of the transition point 1<1.25, 1.03<the value of the transition point 2<1.25, the value of the transition point 1<the value of the transition point 2.

In an exemplary embodiment of the disclosure, the coupling structure is arranged on the dielectric resonant block, and the coupling structure at least includes two nonparallel arranged holes and/or grooves and/or cut corners and/or chamfers.

In an exemplary embodiment of the disclosure, the grooves or the cut corners or the chamfers are arranged on edges of the dielectric resonant block.

In an exemplary embodiment of the disclosure, the holes or grooves are arranged on an end face of the dielectric resonant block, central lines of the holes or grooves are parallel to edges of end faces in which holes or grooves are formed perpendicularly to the dielectric resonant block.

In an exemplary embodiment of the disclosure, the coupling structure is arranged on the cavity, and the coupling structure at least includes two nonparallel arranged chamfers and/or bosses arranged at inner corners of the cavity and/or tapping lines/pieces arranged in the cavity and do not contact with the dielectric resonant block.

In an exemplary embodiment of the disclosure, a frequency tuning device includes a tuning screw arranged on the cavity and/or a film arranged on the surface of the dielectric resonant block and/or a film arranged on the inner wall of the cavity and/or a film arranged on the inner wall of the cover plate.

In an exemplary embodiment of the disclosure, at least one dielectric support frame is arranged on at least one end face of the dielectric resonant block.

The disclosure also discloses a filter with the high-Q triple-mode cavity dielectric resonant hollow structure. The filter includes a cavity, a cover plate and an input/output structure, and the cavity is at least internally provided with one high-Q triple-mode cavity dielectric resonant hollow structure.

In an exemplary embodiment of the disclosure, the high-Q triple-mode cavity dielectric resonant hollow structure is combined with a single-mode resonant structure, a dual-mode resonant structure and a triple-mode resonant structure in different modes to form filters of different volumes; coupling of any two resonant cavities formed by permutation and combination of the high-Q triple-mode dielectric resonant structure, the single-mode resonant structure, the dual-mode resonant structure and the triple-mode resonant structure is achieved through a size of a window between the two resonant cavities necessarily when resonators in the two resonant cavities are parallel, and the size of the window is determined according to a coupling amount; and the filter has function properties of band pass, band stop, high pass, low pass and a duplexer, a multiplexer and a combiner formed thereby.

In an exemplary embodiment of the disclosure, when the tuning frequency of the high-Q triple-mode cavity dielectric resonant hollow structure remains unchanged, a triple-mode Q value is relevant to the ratio K of the side length of the inner wall of the cavity to the side length of the dielectric resonant block, the dielectric constant of the dielectric resonant block and a size variation range of the dielectric resonant block, and the range of the K value is relevant to different resonant frequencies and dielectric constants of the dielectric resonant block and the dielectric support frame.

In the above technical solution, the variation range of the ratio K of the side length of the inner wall of the cavity in the high-Q triple-mode cavity dielectric resonant hollow structure to the size of the dielectric resonant block is that when the K value is increased to the maximum from 1.0, the K value has three Q value transition points within the variation range, each transition point enables the Q value of the base-mode resonant frequency to be transited into the Q value of an adjacent higher-order mode resonant frequency, and when an adjacent Q value of the higher-order mode is transited into the Q value of the base mode, the Q value of the base mode and the Q value of the higher-order mode are increased when being compared with that prior to transition (i.e. both the Q value of the base mode and the Q value of the higher-order mode increase with increasing the K value.).

In an exemplary embodiment, in four areas formed by the start point and the final point of the K value and the three value Q transition points, the Q value of the base mode and the adjacent Q value of the higher-order mode gradually vary along with variation of cavity sizes and dielectric resonant block sizes, and different areas have different requirements when being applied to the filter (application in different areas is explained in the description and examples).

In an exemplary embodiment, the dielectric resonant block of the disclosure is of a solid structure of a cube-like shape, the cube-like shape is defined as that the dielectric resonant block is a cuboid or cube, when the dielectric resonant block has a same size in X, Y and Z axes, a degenerate triple mode is formed, and the degenerate triple-mode is coupled with other single cavities to form a passband filter; when differences of sizes in three directions along the X, Y and Z axes are slightly unequal, orthogonal-like triple-mode resonance is formed, if an orthogonal-like triple-mode is capable of coupling with other cavities into the passband filter, the sizes are acceptable, and if the orthogonal-like triple-mode cannot be coupled with other cavities into the passband filter, the sizes are unacceptable; and when the differences of the sizes in the three directions along the X, Y and Z axes are greatly different, the degenerate triple-mode or orthogonal-like triple-mode cannot be formed, three modes of different frequencies are formed instead, thus the modes cannot be coupled with other cavities into the passband filter, and the sizes are unacceptable.

In an exemplary embodiment, the high-Q triple-mode cavity dielectric resonant hollow structure is internally provided with at least two nonparallel arranged coupling devices for changing the orthogonal property of a degenerate triple-mode electromagnetic field in the cavity, each of the coupling devices includes cut corners and/or holes arranged beside edges of the dielectric resonant block, or includes chamfers and/or cut corners arranged beside the edges of the cavity, or includes cut corners and/or holes arranged beside the edges of the dielectric resonant block, and chamfers/cut corners arranged besides the edges of the cavity, or includes tapping lines or/pieces arranged on nonparallel planes in the cavity, the cut corners take a shape of a triangular prism, a cuboid or a sector, the holes take a shape of a circle, a rectangle or a polygon. After corner cutting or hole formation, in case of frequency holding, side lengths of the dielectric resonant block are increased, and the Q value is slightly decreased; depths of the cut corners or holes are of through or partial cut corners/partial hole structures according to required coupling amounts; the coupling amounts are affected by the sizes of the cut corners/chamfers/holes; the coupling device includes a coupling screw arranged in a direction perpendicular or parallel to the cut corners and/or a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; the coupling screw takes a shape of any one of metallic rods, medium rods, metallic discs, medium discs, metallic rods with metallic discs, metallic rods with medium discs, medium discs with metallic discs and medium rods with medium discs.

In an exemplary embodiment, the high-Q triple-mode cavity dielectric resonant hollow structure forms the degenerate triple-mode in directions along the X, Y and Z axes, and a tuning frequency of the degenerate triple-mode in the direction of an X axis is achieved by additionally installing a tuning screw or a tuning disc at a place with concentrated field intensity on one or two faces of the X axis corresponding to the cavity so as to change a distance or change capacitance; a tuning frequency in the direction of a Y axis is achieved by additionally installing a tuning screw or a tuning disc at a place with concentrated field intensity on one or two faces of the Y axis corresponding to the cavity so as to change a distance or change capacitance; a tuning frequency in the direction of a Z axis is achieved by additionally installing a tuning screw or a tuning disc at a place with concentrated field intensity on one or two faces of the Z axis corresponding to the cavity so as to change a distance or change capacitance; dielectric constant films of different shapes and thicknesses are adhered to a surface of the dielectric resonant block, the inner wall of the cavity or cover plate and the bottom of the tuning screw, and the films are made of a ceramic medium or a ferroelectric material, and frequencies are adjusted by changing dielectric constants; the tuning screw or the tuning disc is made of a metal, or the tuning screw or the tuning disc is made of a metal and the metal is electroplated by copper or electroplated by silver, or the tuning disc or the tuning disc is made of a medium, or the tuning screw or the tuning disc is made of a surface metallized medium; the tuning screw takes a shape of any one of metallic rods, medium rods, metallic discs, medium discs, metallic rods with metallic discs, metallic rods with medium discs, medium discs with metallic discs and medium rods with medium discs; a frequency temperature coefficient of the dielectric resonant block that takes the cube-like shape is controlled by adjusting proportions of medium materials, and is compensated according to frequency deviation variation of the filter at different temperatures; and when the dielectric support frame is fixed with the inner wall of the cavity, in order to avoid stress caused by the cavity and the medium materials in a sudden temperature variation environment, an elastomer for transition is adopted therebetween, so that reliability risks caused by expansion coefficients of materials is buffered.

In an exemplary embodiment, the high-Q triple-mode cavity dielectric resonant hollow structure includes the cavity, the dielectric resonant block and the support frame; when the cavity takes the cube-like shape, a single cube-like dielectric resonant block and the dielectric support frame are installed in any one axial direction of the cavity, and a center of the dielectric resonant block coincides with or approaches to a center of the cavity. An approximate air dielectric support frame supports with any one single face of a cube-like dielectric block, or supports with six faces, or supports with different combinations of two different faces, three faces, four faces and five faces, the dielectric support frame on each face is one or more dielectric support frames, and one or more support frames are installed on different faces according to demands. A support frame of which the dielectric constant is greater than a dielectric constant of air and smaller than a dielectric constant of the dielectric resonant block supports with any one single face of the cube-like dielectric block, or supports with six faces, or supports with different combinations of two different faces, three faces, four faces and five faces; a face without the support frame is air; the air face is arbitrarily combined with the dielectric support frame; the dielectric support frame on each face is one or more dielectric support frames, or is a complex dielectric constant support frame composed of multiple layers of different dielectric constant medium materials; single-layer and multi-layer medium material support frames are arbitrarily combined with cube-like dielectric resonant blocks; one or more support frames are installed on different faces according to demands; on faces with the support frames, to hold the triple-mode frequencies and the Q value, the size corresponding to the axial direction of the dielectric resonant block of the dielectric support frame is slightly reduced; a single face support combination supports any one face of the dielectric resonant block, and particularly an under surface or bearing surface in a vertical direction; a support combination of two faces includes parallel faces such as upper and lower faces, front and rear faces and left and right faces, and also includes nonparallel faces such as upper and front faces, upper and rear faces, upper and left faces and upper and right faces; a support combination of three faces includes three faces perpendicular to one another, or two parallel faces and one nonparallel face; a support combination of four faces includes two pairs of parallel faces or a pair of parallel faces and two another nonparallel faces; a support combination of five faces includes support structures of other faces except any one face of a front face/a rear face/a left face/a right face/an upper face/a lower face; and a support combination of six faces includes support structures of all faces of a front face/a rear face/a left face/a right face/an upper face/a lower face.

In an exemplary embodiment, any end of the cube-like dielectric resonant block and the dielectric support frame are connected in a mode of crimping, adhesion or sintering; connection is one face connection or combined connection of different faces; multi-layer dielectric support frames are fixed in modes of adhesion, sintering, crimping and the like; the dielectric support frame and the inner wall of the cavity are connected in a mode of adhesion, crimping, welding, sintering or screw fixation; a radio frequency channel formed by coupling of radio frequency signals in directions of the X, Y and Z axes of the triple mode causes loss and generates heat, the dielectric resonant block is sufficiently connected with the inner wall of the cavity through the dielectric support frame, and thus the heat is conducted into the cavity for heat dissipation.

In an exemplary embodiment, the cube-like dielectric resonant block has a single dielectric constant or composite dielectric constants; the dielectric resonant block with the composite dielectric constants is formed by at least two materials of different dielectric constants; the materials of different dielectric constants are combined up and down, left and right, asymmetrically or in a nested mode; when the materials of different dielectric constants are nested in the dielectric resonant block, one or more layers are nested; and the dielectric resonant block with the composite dielectric constants needs to comply with variation rules of the Q value transition points. When the dielectric resonant block is subjected to cut side coupling among triple modes, to hold the required frequency, corresponding side lengths of two faces adjacent to the cut sides are adjusted. The dielectric resonant block is made of a ceramic or medium material, and medium sheets of different thicknesses and different dielectric constants are added on the surface of the dielectric resonant block.

In an exemplary embodiment, the dielectric constant of the dielectric support frame is similar to the air dielectric constant, or the dielectric constant of the support frame is greater than the air dielectric constant or smaller than the dielectric constant of the dielectric resonant block; the surface area of the dielectric support frame is smaller than or equal to that of the dielectric resonant block; and the dielectric support frame takes a shape of a cylinder, a cube or a cuboid. The dielectric support frame is of a solid structure or hollow structure, the dielectric support frame of the hollow structure includes a single hole or multiple holes, the hole takes a shape of a circle, a square, a polygon and an arc; the dielectric support frame is made of air, plastics, ceramics and mediums; the dielectric support frame is connected with the dielectric resonant block; when the dielectric constant of the dielectric support is similar to the air dielectric constant, the dielectric support has no effect on the three-mode resonant frequency, when the dielectric constant of the dielectric support frame is greater than the air dielectric constant and smaller than the dielectric constant of the dielectric resonant block, in order to hold original triple-mode frequencies, the size corresponding to the axial direction of the dielectric resonant block of the dielectric support frame is slightly reduced: a support frame with a dielectric constant similar to that of air and a support frame with a dielectric constant smaller than that of the dielectric resonant block are combined and installed in different directions and different corresponding faces of the dielectric resonant block; and when the two support frames of different dielectric constants are combined for use, an axial direction size greater than that of a dielectric resonant block corresponding to an air support frame is slightly reduced on an original basis.

In an exemplary embodiment, the cavity takes the cube-like shape; to achieve coupling of three modes, on premise that the size of the dielectric resonant block is not changed, cut sides for achieving coupling of the three modes are processed on any two adjacent faces of the cavity; the sizes of the cut sides are relevant to required coupling amounts; coupling of two of the three modes is achieved through the cut sides of the cube-like; other coupling is achieved through cut corners of two adjacent sides of the cavity; walls are not broken when corners of the adjacent sides of the cavity are cut; and cut corner faces are completely sealed with the cavity. The cavity is made of a metal or a nonmetal material, the surface of the metal and the nonmetal material is electroplated by copper or silver, and when the cavity is made of the nonmetal material, the inner wall of the cavity needs to be electroplated by a conductive material such as copper or silver, such as plastics and composite materials electroplated by copper or silver.

In an exemplary embodiment, the high-Q triple-mode cavity dielectric resonant hollow structure is combined with a single-mode resonant structure, a dual-mode resonant structure and a triple-mode resonant structure in different modes to form filters of different volumes; coupling of any two resonant cavities formed by permutation and combination of the high-Q triple-mode dielectric resonant structure, the single-mode resonant structure, the dual-mode resonant structure and the triple-mode resonant structure is achieved through a size of a window between the two resonant cavities necessarily when resonators in the two resonant cavities are parallel, and the size of the window is determined according to a coupling amount; and the filter has function properties of band pass, band stop, high pass, low pass and a duplexer, a multiplexer and a combiner formed thereby.

The dielectric constant of the cube-like dielectric resonant block of some embodiments in the disclosure is greater than the dielectric constant of the support frame; when the ratio of the size of the single side of the inner wall of the cavity to the size of the single side of the dielectric resonant block is within 1.03-1.30, the Q value of the higher-order mode is transited into the Q value of the base mode, a triple-mode dielectric Q value of the base mode is increased and the Q value of the higher-order mode is decreased, and compared with single mode and triple-mode dielectric filters known to inventors with same volumes and frequencies, the Q value is increased by 30% or greater; the triple-mode cavity structure is combined with single cavities of different types, for example, the triple-mode cavity structure is combined with a cavity single mode, the triple-mode is combined with the TM mode and the triple-mode is combined with the TE single mode, the greater the number of triple-modes in the filter is, the smaller the volume of the filter is, and the smaller the insertion loss is; the high-Q triple-mode cavity resonant structure generates triple-mode resonance in directions of the X, Y and Z axes, and triple-mode resonance is generated in the directions of the X, Y and Z axes.

When the ratio of the side length of the inner wall of the cavity to the size of a corresponding side length of the dielectric resonant block is within 1.0 to the transition point 1 transited from the Q value, and when the ratio of 1.0, the cavity has a pure medium Q value, when the size of the cavity is increased, the Q value is continuously increased on the basis of a pure medium, the Q value of the higher-order mode is greater than the Q value of the base mode, and when the ratio is increased to the transition point 1, an original Q value of the higher-order mode is approximated to a new Q value of the base mode.

After entering into the transition point 1, in case that the base-mode resonant frequency is maintained, the Q value of the base mode is greater than the Q value of the higher-order mode. Along with increase of the ratio, the sizes of the dielectric block and the cavity are both increased, the Q value of the base mode is also increased, and the Q value of the higher-order mode is also increased; when the ratio is approximate to the transition point 2 of Q value transition, the Q value of the base mode is the highest, between the transition point 1 transited from the Q value of the base mode and the transition point 2 transited from the Q value of the base mode, the frequency of the higher-order mode is approximate to or far away from the frequency of the base mode along with variation of the ratio of the cavity to the dielectric resonant block between the transition point 1 and the transition point 2 at times.

After entering the transition point 2, the Q value of the base mode is smaller than the Q value of the higher-order mode; along with increase of the ratio, the size of the dielectric resonant block is reduced, the size of the cavity is increased, the Q value of the base mode is constantly increased, and when the ratio is approximate to a transition point 3, the Q value of the base mode is approximate to the Q value at the transition point 2.

When the ratio enters the transition point 3, the Q value of the base mode is increased along with increase of the ratio, the Q value of the higher-order mode is decreased along with increase of the ratio, the size of the dielectric resonant block is decreased along with increase of the ratio, and the size of the cavity is constantly increased; when the size is approximate to a ¾ wavelength size of the cavity, the size of the dielectric resonant block is constantly decreased, the Q value of the base mode is also decreased, and the frequency of the higher-order mode is approximate to or far away from the frequency of the base mode along with increase of the ratio at times. A particular ratio of the size of the transition points is relevant to dielectric constants and frequencies of the dielectric resonant block and single or composite dielectric constants of the dielectric resonant block.

The side length of the inner wall of the cavity and the side length of the dielectric resonant block may be or may be not equal in three directions of the X, Y and Z axes. The triple mode is formed when the sizes of the cavity and the cube-like dielectric resonant block are equal in the X, Y and Z axes; size differences in three directions of the X, Y and Z axes may also be slightly unequal; when the sizes of single sides of the cavity in one direction of the X, Y and Z axes and the corresponding dielectric resonant block is different from the sizes of single sides in other two directions of the X, Y and Z axes, or any one of the sizes of symmetric single sides of the cavity and the dielectric resonant block are also different from the sizes of single sides in the other two directions, the frequency of one of the triple modes varies and is different from frequencies of the other two modes of the triple modes, and the larger the size difference is, the larger the difference of the frequency of one mode from those of the other two modes is; when the size in one direction is greater than the sizes in the other two directions, the frequency is decreased on an original basis; when the size in one direction is smaller than those in the other two directions, the frequency is increased on the original basis, and the triple mode is gradually transited into a dual-mode or single mode; if the sizes of the cavity and the resonant block in three axial directions are greatly different, and when the sizes of symmetric single sides in three directions of the X, Y and Z axes are different, frequencies of three modes of the triple modes are different; when the sizes of side lengths in three directions are greatly different, the base mode is a single mode; and when the sizes of the side lengths in three directions are not greatly different, the frequencies are not greatly different, and although the frequencies vary, a triple-mode state may also be maintained through the tuning device.

Coupling of triple modes is achieved through at least two nonparallel arranged coupling devices for changing the orthogonal property of the degenerate triple-mode electromagnetic field in the cavity in the high-Q triple-mode cavity resonant structure of the cavity, the coupling devices include cut corners and/or holes arranged beside the edges of the dielectric resonant block, or include chamfers and/or cut corners arranged beside the edges of the cavity, or include cut corners and/or holes arranged beside the edges of the dielectric resonant block, and chamfers/cur corners beside the edges of the cavity, or include tapping lines or/pieces arranged on nonparallel planes in the cavity, the cut corners take the shape of the triangular prism, the cuboid or the sector, the holes take the shape of the circle, the rectangle or the polygon. After corners are cut or holes are formed, in case of frequency maintenance, side lengths of the dielectric resonant block are increased, and the Q value is slightly decreased. Depths of the cut corners or holes are of through or partial cut corners/partial hole structures according to required coupling amounts, and the coupling amounts are affected by the sizes of the cut corners/chamfers/holes. A coupling screw is arranged on each coupling device in a direction perpendicular or parallel to the cut corners and/or a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; the coupling screw takes a shape of any one of metallic rods, medium rods, metallic discs, medium discs, metallic rods with metallic discs, metallic rods with medium discs, medium rods with metallic discs and medium rods with medium discs.

The tuning frequency of the triple mode in the direction of the X axis is achieved by installing the tuning screw or the tuning disc at the place with concentrated field intensity on one or two faces of the cavity corresponding to the X axis so as to change the distance or change capacitance; the tuning frequency in the direction of the Y axis is achieved by additionally installing the tuning screw or the tuning disc at the place with concentrated field intensity on one or two faces of the Y axis corresponding to the cavity so as to change the distance or change capacitance; and the tuning frequency in the direction of the Z axis is achieved by additionally installing the tuning screw or the tuning disc at the place with concentrated field intensity on one or two faces of the Z axis corresponding to the cavity so as to change the distance or change capacitance.

The triple-mode structure with Q value transition of the dielectric resonant is arbitrarily arranged and combined with the single-mode resonant structure, the dual-mode resonant structure and the triple-mode resonant structure in different modes to form required filters of different sizes; the filter has function properties of band pass, band stop, high pass, low pass and the duplexer, the multiplexer formed between them; and coupling of any two resonant cavities formed by permutation and combination of the single-mode resonant structure, the dual-mode resonant structure and the triple-mode resonant structure is achieved through the size of the window between the two resonant cavities necessarily when resonators in two resonant structures are parallel.

Some embodiments of the disclosure have the beneficial effects that the structure is simple in structure and convenient to use; by setting the ratio of the size of the single side of the inner wall of a metallic cavity of a dielectric multiple mode to the size of the single side of the dielectric resonant block within 1.01-1.30, the resonant block is matched with the cavity to form the multiple-mode structure while reverse turning of specific parameters is achieved, and thus a high Q value is ensured when the resonant block and the cavity are at a small distance apart. Furthermore, some embodiments disclose a filter with the high-Q triple-mode cavity resonant structure, and compared with a triple-mode filter known to inventors, the filter has insertion loss reduced by 30% or greater on premise of same frequencies and same volumes. Dielectric resonant frequency transition triple-mode structures formed by the cube-like dielectric resonant block, the dielectric support frame and the cover plate of the cavity of the disclosure have magnetic fields orthogonal to and perpendicular to one another in directions of the X, Y and Z axes, thus three non-interfering resonant modes are formed, a higher-order mode frequency is transited into a high Q value base-mode frequency, coupling is formed among three magnetic fields, and different bandwidth demands of the filters are met by adjusting coupling intensity. When two filters with the high-Q triple-mode cavity resonant structure are used in a typical 1800 MHz frequency filter, a volume equivalent to six single cavities of an original cavity is achieved, the volume may be reduced by 40% on the basis of an original cavity filter, and the insertion loss may also be reduced by about 30%. Since the volume is greatly reduced, and the processing time and electroplating areas are correspondingly reduced, the cost is still equivalent to that of the cavity although the dielectric resonant block is used, if the material cost of the dielectric resonant block is greatly reduced, the design may have obvious cost advantages, when the filter has multiple cavities, three triple-mode structure is used, and volume and performance are obviously improved.

The high-Q triple-mode dielectric resonant structure has significant advantages in terms of volume. Furthermore, in the case where the single cavity volume is small, the Q value of the cavity high-Q multimode dielectric resonant structure is significantly higher than the Q value of the other forms of single cavity. With the high-Q triple-mode dielectric resonant structure, a volume of the filter is reduced by more than 30%. Meanwhile, the loss of the filter is reduced by 30%, and when the performance of the high-Q triple-mode dielectric resonant structure filter is the same as that of the conventional filter, the volume is significantly reduced by more than 50% relative to a conventional cavity filter.

A high-Q triple-mode cavity dielectric resonant hollow structure includes a cavity 1 and a cover plate 4, wherein the cavity and the cover plate 4 are tightly connected, the cavity is internally provided with a dielectric resonant block 2 and a dielectric support frame 3, and the dielectric support frame is connected with an inner wall of the cavity.

Simulation Embodiment 1

As shown in FIG. 1, a high-Q triple-mode cavity dielectric resonant hollow structure includes a cavity 1 and a cover plate 4, wherein the cavity 1 is internally provided with a dielectric resonant block and 6 dielectric support frames, and each of the dielectric support frames is of cylinder-shaped.

Figure 2:
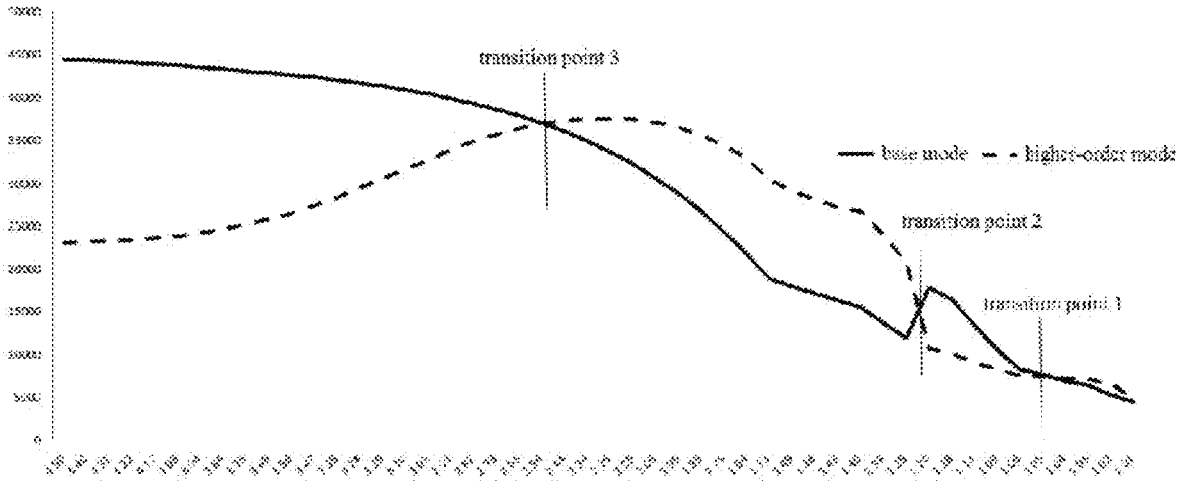
FIG. 2 shows a curve that a Q value varies along with a ratio of a side length of an inner wall of a cavity to a side length of a dielectric resonant block, a transverse coordinate is the ratio of the side length of the inner wall of the cavity to the side length of the dielectric resonant block, and a vertical coordinate is the Q value.

In order to clarify the essence of the disclosure more clearly, further illustration is made with data below: in data of the following table, a base-mode frequency of a multi-mode resonant structure is controlled within a range of 1880 MHz±5 MHz, Er35 is adopted as a medium, material Q*F=80,000, a side length of a single cavity is varied, in order to ensure a base-mode resonant frequency, the size of a dielectric resonant block correspondingly varies, that is, a single cavity Q value varies along with A1/A2. Variation of curves and transition points of Q values of a base mode and a higher-order mode adjacent to the base mode along with A1/A2=K is shown in FIG. 2. When A1/A2 enters a transition point 1, within a use frequency band, a single cavity Q value of the base mode is increased, and a single cavity Q value of the higher-order mode adjacent to the base mode is decreased;

when A1/A2 enters a transition point 2, within a use frequency band, a single cavity Q value of the base mode is decreased, and a single cavity Q value of the higher-order mode adjacent to the base mode is increased;

when A1/A2 enters a transition point 3, within a use frequency band, a single cavity Q value of the base mode is increased along with the size increases, and a single cavity Q value of the higher-order mode adjacent to the base mode is decreased along with the size increases;

when A1/A2 is within 1.0 to the transition point 1, the Q value of the higher-order mode adjacent to the base mode is increased along with increase of the ratio, the single cavity Q value of the base is increased along with increase of the ratio, but the single cavity Q value of the higher-order mode adjacent to the base mode is greater than the single cavity Q value of the base mode, and the single cavity is coupled with other cavities to form a cavity filter of a small volume and ordinary performance;

when A1/A2 is within the transition point 1 to the transition point 2, the Q value of the higher-order mode adjacent to the base mode is increased along with increase of the ratio, the single cavity Q value of the base is increased along with increase of the ratio, but the single cavity Q value of the base mode is greater than the single cavity Q value of the higher-order mode adjacent to the base mode, and the single cavity is coupled with other cavities to form a cavity filter of a small volume and higher performance;

when A1/A2 is within the transition point 2 to the transition point 3, the Q value of the higher-order mode adjacent to the base mode is increased first and then decreased along with increase of the ratio, the single cavity Q value of the base is increased and then decreased along with increase of the ratio, but the single cavity Q value of the base mode is smaller than the single cavity Q value of the higher-order mode adjacent to the base mode, and the single cavity is coupled with other cavities to form a cavity multi-mode filter of a large volume and good performance;

when A1/A2 is within the transition point 3 to the maximum value, the Q value of the higher-order mode adjacent to the base mode is decreased along with increase of the ratio, the single cavity Q value of the base mode is increased along with increase of the ratio, but the single cavity Q value of the base mode is greater than the single cavity Q value of the higher-order mode adjacent to the base mode; and when approaching a single cavity size and a ¾ wavelength, the single cavity Q value of the base mode is decreased along with increase of the ratio, and the single cavity is coupled with other cavities to form a cavity filter of a larger volume and better performance.

Simulation Embodiment 2

Figures 3, 4:
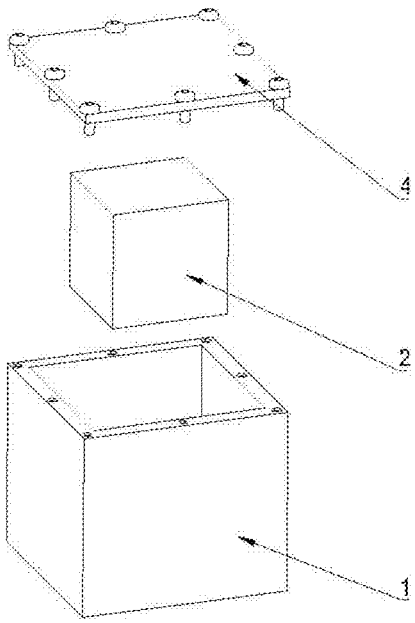
FIG. 3 shows a theoretical structural schematic diagram of a model of a high-Q triple-mode cavity dielectric resonant hollow structure.
FIG. 4 shows a simulation result of a single cavity frequency and a Q value of the structure shown in FIG. 3.

As shown in FIG. 3, the high-Q triple-mode cavity dielectric resonant hollow structure includes a cavity 1 and a cover plate 4, wherein the cavity 1 is internally provided with a dielectric resonant block. When an inner wall of a single cavity is 33 mm*33 mm*33 mm in length, width and height, the size of the dielectric resonant block is 27.43 mm*27.43 mm*27.43 mm (without the dielectric support frame, and the dielectric support frame is air equivalently); and when the dielectric constant of the dielectric resonant block is 35, and material Q*F=80,000, triple modes are formed, a frequency is 1881 MHz, the Q value is up to 17746.8, and a specific simulation result is shown in FIG. 4.

| | Frequency | Q value |
|---|---|---|
| Mode 1 | 1881.60 | 17746.8 |
| Mode 2 | 1881.93 | 17771.3 |
| Mode 3 | 1882.56 | 17797.2 |
| Mode 4 | 1905.31 | 10678.2 |

Simulation Embodiment 3

Figures 5, 6:
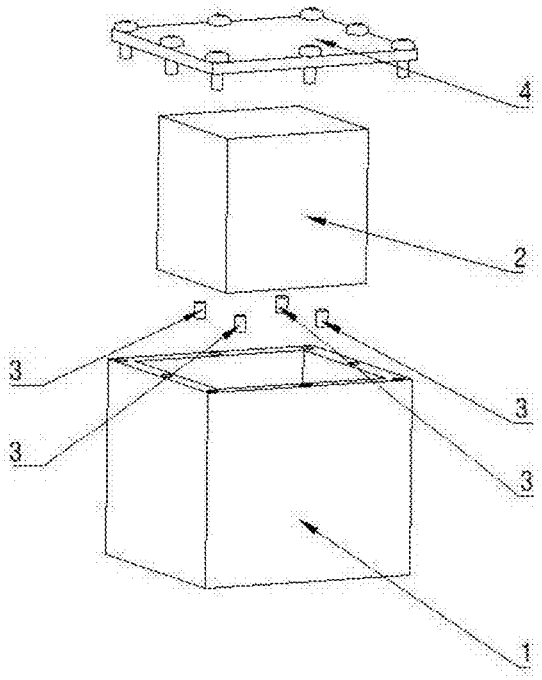
FIG. 5 shows an assembly drawing of a high-Q triple-mode cavity dielectric resonant hollow structure with multiple coplane supports.
FIG. 6 shows a simulation result of a single cavity frequency and a Q value of the structure shown in FIG. 5.

As shown in FIG. 5, the high-Q triple-mode cavity dielectric resonant hollow structure includes a cavity 1 and a cover plate 4, wherein the cavity 1 is internally provided with a dielectric resonant block and a plurality of coplane dielectric support frames, and the dielectric support frames are of cylinder-shaped (or cuboid-shaped). When an inner wall of a single cavity is 33 mm*33 mm*33 mm in length, width and height, the size of the dielectric resonant block is 27.43 mm*27.43 mm*27.43 mm (with the dielectric support frame, a diameter of the dielectric support frame is 2 mm, when the dielectric constant is 1.06, loss tangent is 0.0015); and when the dielectric constant of the dielectric resonant block is 35, and the material Q*F=80,000, triple modes are formed, a frequency is 1881 MHz, and the Q value is up to 17645. A specific simulation result is shown in FIG. 6.

| | Frequency | Q value |
|---|---|---|
| Mode 1 | 1885.20 | 17645.1 |
| Mode 2 | 1885.27 | 17452.1 |
| Mode 3 | 1885.34 | 17770.4 |
| Mode 4 | 19005.27 | 10672.9 |

Simulation Embodiment 4

Figures 7, 8:
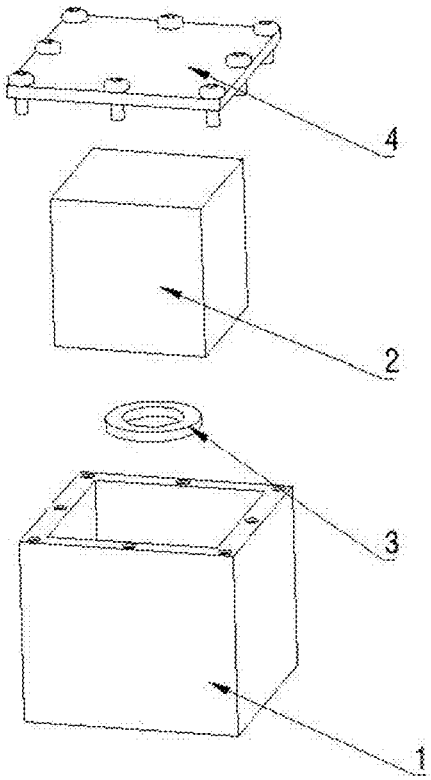
FIG. 7 shows an assembly drawing of a high-Q triple-mode cavity dielectric resonant hollow structure with a single dielectric support frame.
FIG. 8 shows a simulation result of a single cavity frequency and a Q value of the structure shown in FIG. 7.

As shown in FIG. 7, the high-Q triple-mode cavity dielectric resonant hollow structure includes a cavity 1 and a cover plate 4, wherein the cavity 1 is internally provided with a dielectric resonant block and a single dielectric support frame, and the dielectric support frame is takes the shape of a circular ring. When an inner wall of a single cavity is 33 mm*33 mm*33 mm in length, width and height, the size of the dielectric resonant block is 27.83 mm*27.83 mm*26.13 mm (with the dielectric support frame, an outer diameter of the dielectric support frame is 7 mm, an inner diameter is 3.2 mm, the dielectric constant is 9.8, and the material Q*F=100,000); when the dielectric constant of the dielectric resonant block is 35, and the material Q*F=80,000, triple modes are formed, a frequency is 1880 MHz, and the Q value is up to 17338.3. A specific simulation result is shown in FIG. 8.

| | Frequency | Q value |
|---|---|---|
| Mode 1 | 1879.50 | 17338.3 |
| Mode 2 | 1881.11 | 17017.3 |
| Mode 3 | 1881.20 | 17022.8 |
| Mode 4 | 1901.85 | 10597.5 |

Simulation Embodiment 5

Figures 9, 10:
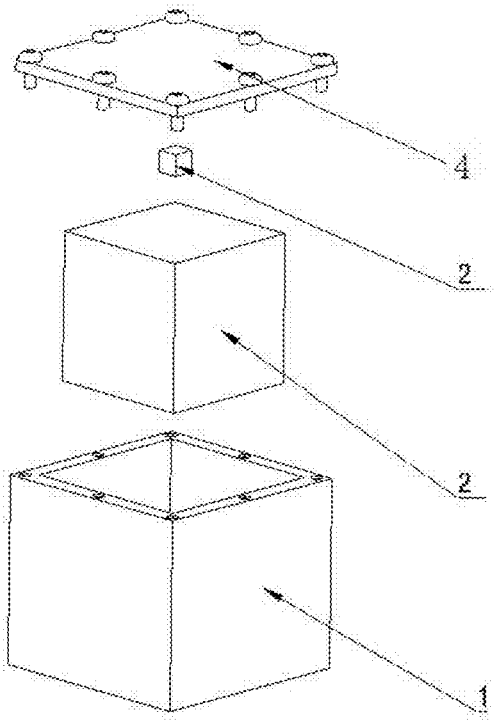
FIG. 9 shows an assembly drawing of a nested high-Q triple-mode cavity dielectric resonant hollow structure.
FIG. 10 shows a simulation result of a single cavity frequency and a Q value of the structure shown in FIG. 9.

As shown in FIG. 9, the high-Q triple-mode cavity dielectric resonant hollow structure includes a cavity 1 and a cover plate 4, wherein the cavity 1 is internally provided with a dielectric resonant block, the dielectric resonant block consists of different dielectric constants, and a medium of a high dielectric constant is nested in a medium of a low dielectric constant. When an inner wall of a single cavity is 33 mm*33 mm*33 mm in length, width and height, the size of the dielectric resonant block is 27.46 mm*27.46 mm*27.46 mm, the dielectric constant of the dielectric resonant block is 35, the material Q*F=80,000, the dielectric constant of a middle nested dielectric resonant block of the medium is 68, the material Q*F=12,000, a filling volume is 2 mm*2 mm*2 mm, triple modes are also formed, a frequency is 1881, the Q value is up to 17635.8, and specific simulation result is shown in FIG. 10.

| | Frequency | Q value |
|---|---|---|
| Mode 1 | 1881.67 | 17635.9 |
| Mode 2 | 1881.90 | 17650.3 |
| Mode 3 | 1882.32 | 17671.7 |
| Mode 4 | 1906.14 | 10702.8 |

Simulation Embodiment 6

As shown in the figures, the high-Q triple-mode cavity dielectric resonant hollow structure includes a cavity 1 and a cover plate 4, wherein the cavity 1 is internally provided with a dielectric resonant block, the dielectric resonant block consists of different dielectric constants, and a medium of a high dielectric constant is nested in a medium of a low dielectric constant. When the body of a single cavity is 33 mm*33 m*33 mm in length, width and height, the size of a cube-like dielectric resonant block is 27.46 mm*27.46 mm*27.46 mm, a medium cube-like dielectric resonant block has a composite dielectric constant, when the dielectric constant of an outer cube-like dielectric resonant block is 35, the dielectric constant of a middle nested dielectric resonant block of the medium is 68, and a filling volume is 2 mm*2 mm*2 mm. Triple modes are also formed, a frequency is 1881, and the Q value is up to 17635.8.

| | Frequency | Q value |
|---|---|---|
| Mode 1 | 1881.67 | 17635.9 |
| Mode 2 | 1881.90 | 17650.3 |
| Mode 3 | 1882.32 | 17671.7 |
| Mode 4 | 1906.14 | 10702.8 |

Simulation Embodiment 7

Figure 11:
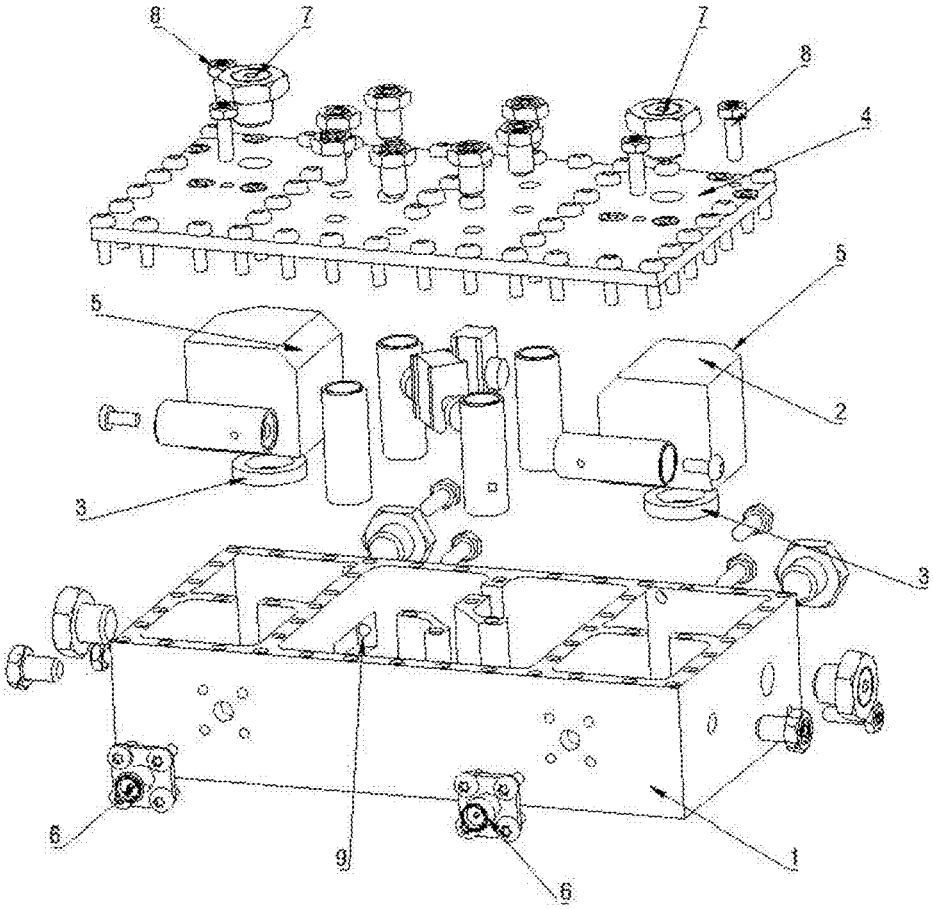
FIG. 11 shows an assembly drawing of a filter with a cavity high-Q triple-mode dielectric resonant hollow structure, triple modes are coupled in an edge cut manner, and a dielectric resonant block is achieved through a circular ring dielectric support frame.

A filter with the high-Q triple-mode cavity dielectric resonant hollow structure includes a cavity 1, a cover plate 4 and an input/output 6, wherein the cavity body is internally provided with a chamber similar to a metallic cavity filter, a metallic resonant rod and a tuning screw, and a coupling window or a fly rod/fly rod base and a coupling screw are arranged among cavities. In an embodiment, the filter is at least provided with the cavity high-Q triple-mode structure, the cavity of the cavity high-Q triple-mode structure is provided with a dielectric resonant block, the dielectric resonant block is supported by a circular ring medium, and multi-mode coupling of dielectric resonant blocks is achieved in an edge cut manner. A 12-cavity 1.8 GHz triple-mode cavity high-Q dielectric filter is shown in FIG. 11, the filter adopts six metallic single cavities and two high-Q triple-mode dielectric resonant structures as well, and three inductive cross couplings and three capacitive cross couplings are formed.

Achieved Performance:

bandpass frequency: 1,805 MHz-1,880 MHz, attenuation>−108 dBm@1710-1785 MHz,

−108 dBm@1,920-2,000 MHz, volume: 129 mm*66.5 mm*35 mm.

Figure 12:
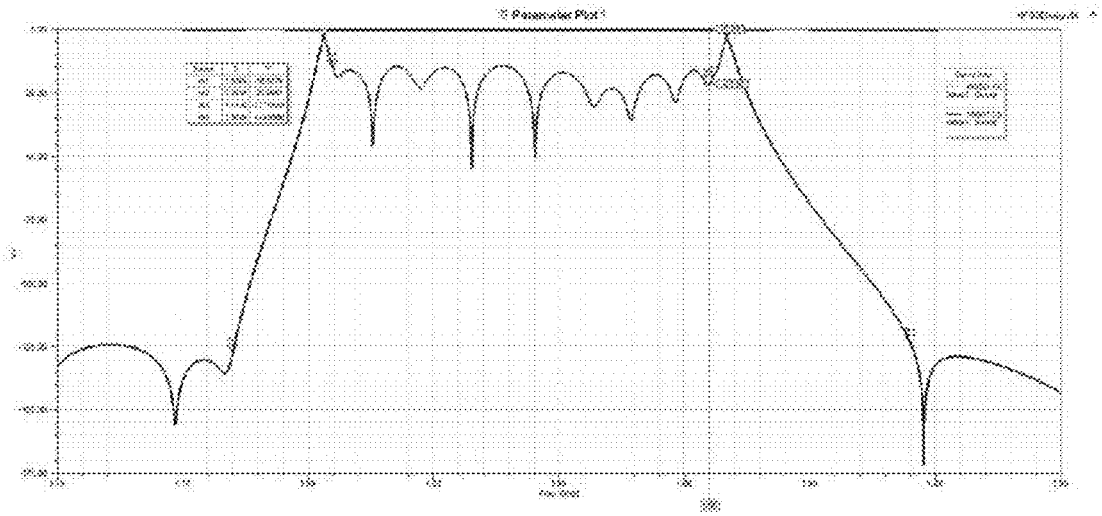
FIG. 12 shows a simulation curve corresponding to the filter shown in FIG. 11.
Figure 13:
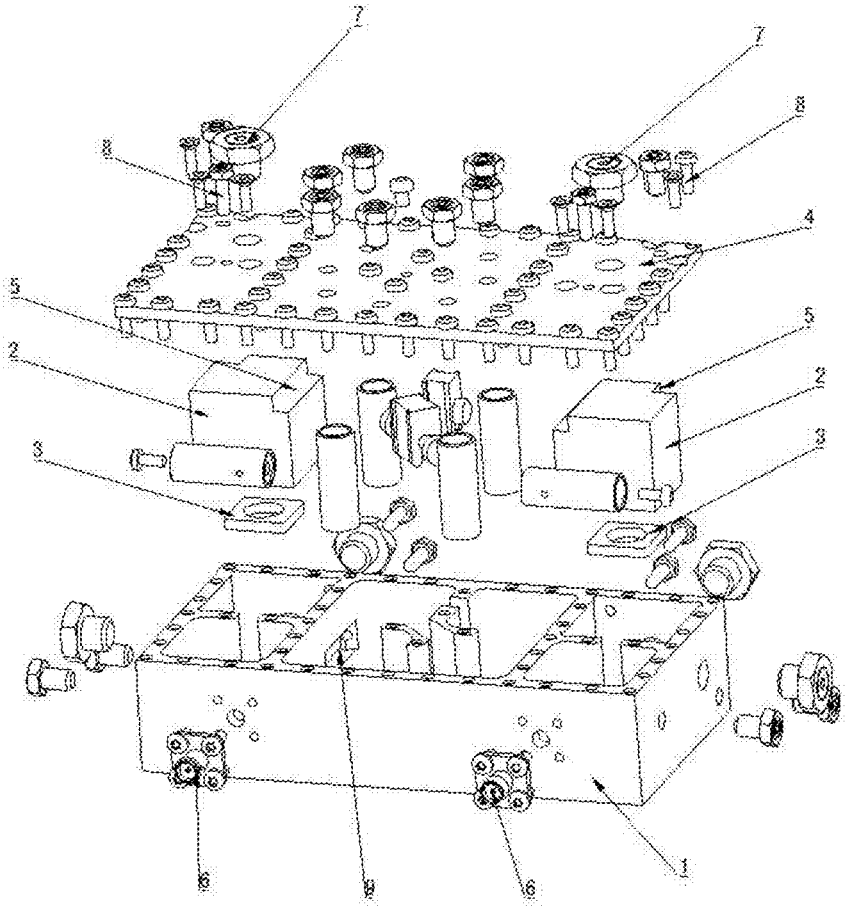
FIG. 13 shows an assembly drawing of a filter with a cavity high-Q triple-mode dielectric resonant hollow structure, triple modes are coupled in a right angle (step) cut manner, and a dielectric resonant block is achieved through a square circular dielectric support frame.

See a specific simulation curve in FIG. 12.

Simulation Embodiment 8

In an embodiment, the filter with the high-Q triple-mode cavity dielectric resonant hollow structure includes a cavity 1, a cover plate 4 and an input/output 6, wherein the cavity is internally provided with a chamber similar to a metallic cavity filter, a metallic resonant rod and a tuning screw 7, and a coupling window or a fly rod/fly rod base and a coupling screw are arranged among cavities. In an embodiment, the filter is at least provided with the cavity high-Q triple-mode structure, the cavity of the cavity high-Q triple-mode structure is provided with a dielectric resonant block, the dielectric resonant block is supported by a square circular medium, and multi-mode coupling of dielectric resonant blocks is achieved in a right angle (step) cut manner. A 12-cavity 1.8 GHz triple-mode cavity high-Q dielectric filter is shown in FIG. 11, the filter adopts six metallic single cavities and two high-Q triple-mode dielectric resonant structures as well, and three inductive cross couplings and three capacitive cross couplings are formed. Achieved typical performance: bandpass frequency: 1,805 MHz-1,880 MHz, minimum point insertion loss is about 0.52 dB, attenuation>−108 dBm@1,710-1,785 MHz, −108 dBm@1,920-2,000 MHz, volume: 129 mm*66.5 mm*35 mm.

Figure 14:
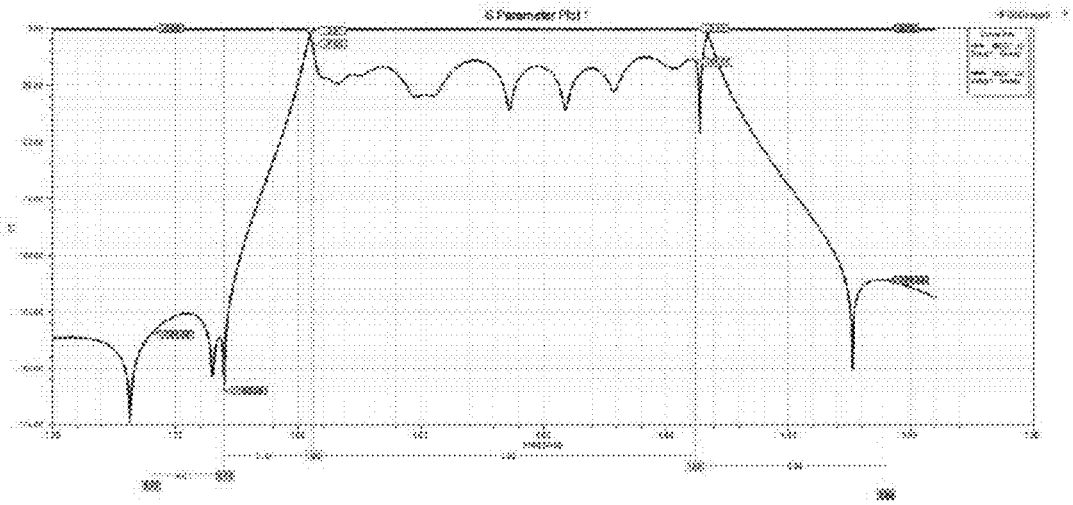
FIG. 14 shows a simulation curve corresponding to the filter shown in FIG. 13.
Figure 15:
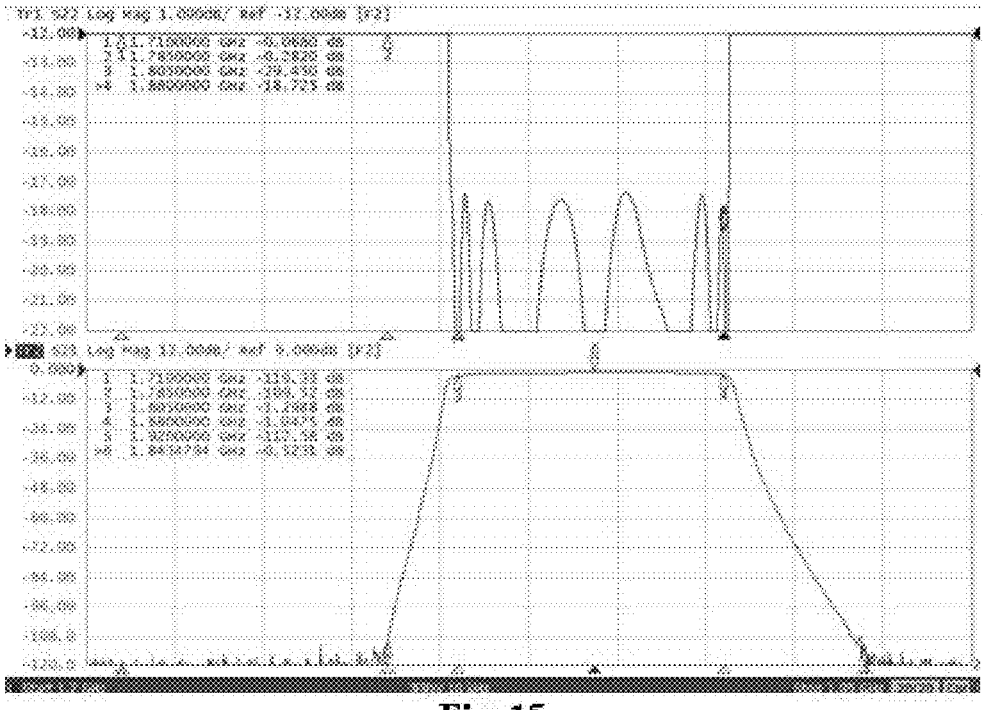
FIG. 15 shows an S parameter testing curve corresponding to the filter shown in FIG. 13.
Figure 16:
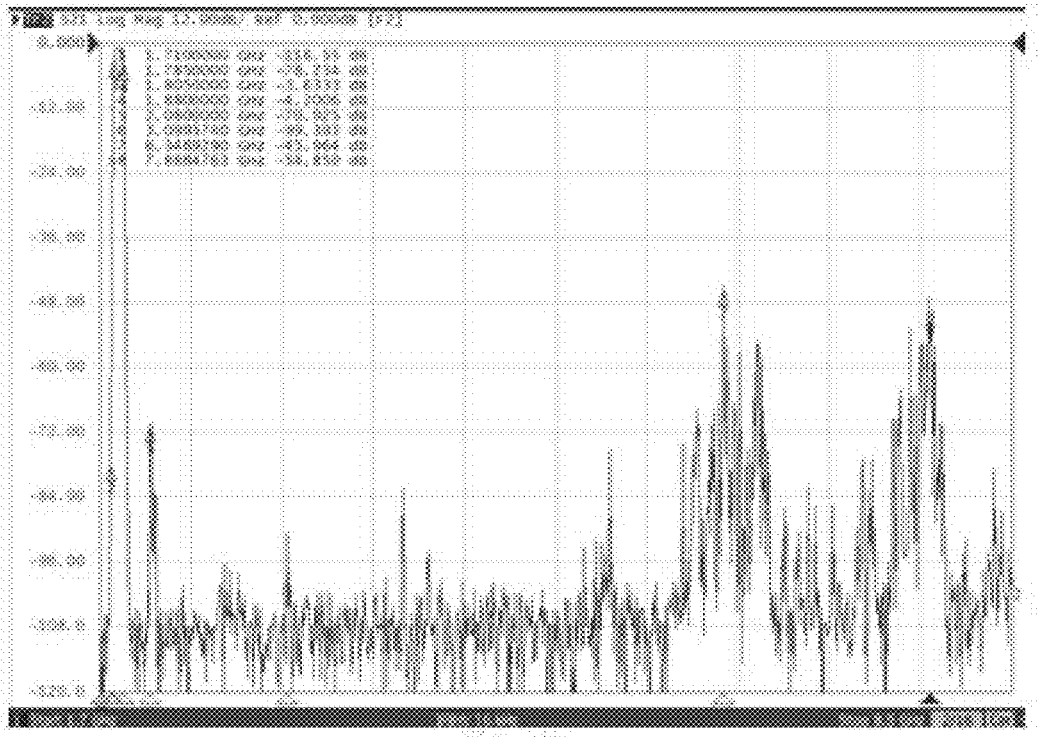
FIG. 16 shows a 8.5 GHz harmonic response testing curve of the filter shown in FIG. 13.

See a specific simulation curve in FIG. 14, see an entity S parameter testing curve in FIG. 15, and see a 8.5 GHz harmonic response curve in FIG. 16.

Simulation results of a conventional Transverse Electric (TE) mode medium and a Transverse Magnetic (TM)-mode medium in a single cavity of a same volume and a same frequency and ¾ wavelength metallic single cavity with a same frequency are shown as follows.

Comparison Example 1

Single Cavity of TE-Mode Dielectric Resonator

Simulation conditions: single cavity 33*33*33, support column ER9.8, radius r1=3.5 mm, height 9 mm, dielectric resonant block ER43, QF=43000, radius 14.3 mm, height 15 mm, F=1880.

Simulation result: when the frequency is 1882.6 MHz, the single cavity Q value is 11022.

| | Frequency | Q value |
|---|---|---|
| Mode 1 | 1882.61 | 11022.9 |
| Mode 2 | 2167.64 | 14085.4 |
| Mode 3 | 2167.67 | 14067.6 |
| Mode 4 | 2172.50 | 18931.7 |

Comparison Example 2

Single Cavity of TM-Mode Dielectric Resonator

Simulation conditions: single cavity 33*33*33, dielectric resonant block ER35, QF=80000, radius 5.8 mm, inner diameter 5.8-3=2.8 mm, height 33 mm, F=1880.

Simulation result: when the frequency is 1878.5 MHz, the single cavity Q value is 7493.

| | Frequency | Q value |
|---|---|---|
| Mode 1 | 1878.50 | 7493.67 |
| Mode 2 | 3157.94 | 9161.01 |
| Mode 3 | 3157.98 | 9160.74 |
| Mode 4 | 32276.4 | 12546.6 |

Comparison Example 3

¾ Wavelength Cavity

Simulation conditions: single cavity 112.6*112.6*1126, dielectric resonant block ER35, QF=80000, radius 5.8 mm, inner diameter 5.8−3=2.8 mm, height 33 mm, F=1880.

Simulation result: when the frequency is 1880 MHz, the single cavity Q value is 20439.

| | Frequency | Q value |
|---|---|---|
| Mode 1 | 1882.81 | 20439.6 |
| Mode 2 | 1882.95 | 20400.8 |
| Mode 3 | 1882.98 | 20444.3 |
| Mode 4 | 2306.87 | 16992.2 |

Comparison Example 4

1800 MHz 12 Cavity Filter

Six metallic single cavities and two high-Q triple-mode dielectric resonant structures as well are used, and two inductive cross couplings and four capacitive cross couplings are formed.

Achieved Typical Performance:

Bandpass frequency: 1805 MHz-1880 MHz

Insertion loss: <−0.9 dB;

Attenuation to 1710-1785 MHz is >120 dBm;

Volume: 129 mm*66.5 mm*35 mm;

Performance and bandpass frequency with 12 metallic single cavities: 1805 MHz-1880 MHz Insertion loss: <−1.3 dB;

Attenuation to 1710-1785 MHz is >120 dBm;

Volume: 162 mm*122 mm*40 mm;

Brief Summary

| | Single cavity volume | Frequency | Q value |
|---|---|---|---|
| Medium Q value transition triple-mode | 33 mm * 33 mm * 33 mm; | 1880 MHz | 17746 |
| TE single mode | 33 mm * 33 mm * 33 mm; | 1880 MHz | 11022 |
| TM single mode | 33 mm * 33 mm * 33 mm; | 1880 MHz | 7493 |
| ¾ wavelength cavity | 112.6 mm * 112.6 mm * 112.6 mm; | 1880 MHz | 20439 |

From the above table, it can be obtained that a ratio of the medium Q-value conversion triple-mode to a Q-value of TE single-mode under the same single-cavity volume and frequency is 17746/11022=1.61. Under the same single cavity volume and frequency, the Q-value ratio of TE single mode and TM single mode is 11022/7493=1.47.

Comparison of embodiments 1-5 and comparison examples 1-3 shows:

1. In simulation of a single cavity of a triple-mode dielectric transition structure, a Q value is greatly higher than a Q value prior to transition on premise that the volume of the single cavity is not greatly different in case of Q value transition.

2. In simulation of the single cavity of the triple-mode dielectric transition structure, in case of a same frequency and a same volume, the Q value is greatly higher than those of the TE dielectric single mode and the TM dielectric single mode.

| | Bandpass frequency | Insertion loss | volume |
|---|---|---|---|
| Metallic single-mode filter | 1805-1880 MHz | 1.3 dB | 162 mm * 122 mm * 40 mm |
| High-Q triple-mode dielectric filter | 1805-1880 MHz | 0.9 dB | 129 mm * 66.5 mm * 35 mm |

Comparison of embodiments 1-7 and the comparison example 4 shows:

the embodiments show that when the ratio of the side length of the single cavity to the side length of the cube-like dielectric resonant block is within 1.03-1.30, that is, within the transition point 1 to the transition point 2, transition and increase of the Q value are achieved, the Q value is increased by 30% or greater when being compared with that of a triple-mode single cavity beyond the side length ratio, compared with the conventional TE and TM dielectric single modes, the Q value is conspicuously increased in case of same volumes and frequencies, and a dielectric resonant structure triple mode applied to the filter has remarkable advantages in volume and performance.

The high-Q triple-mode dielectric resonant structure has significant advantages in terms of volume. Furthermore, in the case where the single cavity volume is small, the Q value of the cavity high-Q multimode dielectric resonant structure is significantly higher than the Q value of the other forms of single cavity. With the high-Q triple-mode dielectric resonant structure, a volume of the filter is reduced by more than 30%. Meanwhile, the loss of the filter is reduced by 30%, and when the performance of the high-Q triple-mode dielectric resonant structure filter is the same as that of the conventional filter, the volume is significantly reduced by more than 50% relative to a conventional cavity filter.

Some embodiments of the disclosure aim to overcome defects of the art known to inventors, a dielectric resonant structure Q value transition triple-mode structure is provided, overall insertion loss of the filter is reduced, Q value of the higher-order mode transition is achieved through size ratio relationships of a single cube-like dielectric block and a hollow cube-like dielectric resonant block to the size of the inner wall of the cavity, and requirements of cavity filters on higher Q values and smaller volume are met.

It is to be understood that the above are only embodiments of the disclosure, but the scope of protection of the disclosure is not limited to this. Changes or replacements easily made by any of those skilled in the art within the scope of the technology disclosed by the disclosure shall be covered by the scope of protection of the disclosure.

What is claimed is:

1. A high-Q triple-mode cavity dielectric resonant hollow structure for a filter, comprising a cavity and a cover plate, wherein the cavity is internally provided with a dielectric resonant block and a dielectric support frame; the dielectric resonant block takes a cube-like shape and is internally provided with a hollow chamber; the dielectric support frame is connected with the dielectric resonant block and an inner wall of the cavity, respectively; the dielectric resonant block and the dielectric support frame form a triple-mode dielectric resonator; a dielectric constant of the dielectric support frame is smaller than a dielectric constant of the dielectric resonant block; the hollow chamber is of a cube-like shape; when a ratio of size of the single side of the dielectric resonant block to a size of a corresponding single side of the hollow chamber is greater than 6, the transited Q value of the base mode remains generally unchanged, and when the ratio of the single side of the dielectric resonant block to the size of the corresponding single side of the hollow chamber is smaller than 6, the transited Q value of the base mode is greatly decreased;

a ratio K of a size of a single side of the inner wall of the cavity to a size of a corresponding single side of the dielectric, resonant block is: K is greater than or equal to a transition point 1 and is smaller than or equal to a transition point 2, a Q value of a higher-order mode adjacent to a base mode of a triple-mode cavity resonant structure is transited into a Q value of the base mode of the triple-mode cavity resonant structure, a base-mode resonant frequency after transition is equal to a base-mode resonant frequency prior to transition, a Q value of the base mode after transition is greater than a Q value of the base mode prior to transition, and a Q value of the higher-order mode adjacent to the base mode after transition is smaller than a Q value of the higher-order mode adjacent to the base mode prior to transition;

the triple-mode dielectric resonant structure is internally provided with a coupling structure for changing an orthogonal property of an electromagnetic field of a degenerate triple-mode in the cavity; and the triple-mode dielectric resonant structure is internally provided with a frequency tuning device for changing a tuning frequency of the degenerate triple-mode in the cavity;

wherein a value of the transition point 1 and a value of the transition point 2 both vary according to different base-mode resonant frequencies of the dielectric resonant structure, dielectric constants of the dielectric resonant block and dielectric constants of the support frame;

wherein when the base-mode resonant frequency of the dielectric resonant structure after transition remains unchanged, the Q value of the triple-mode cavity resonant structure is relevant to the K value, the dielectric constant of the dielectric resonant block and the size of the dielectric resonant block;

wherein when the K value is increased to the maximum from 1.0, the K value has three Q value transition points within a variation range, each Q value transition point enables the Q value of the base mode and the Q value of the higher-order mode adjacent to the base mode to be transited; when the value of the base mode is lower than the Q value of the higher-order mode adjacent to the base mode, the Q value of the higher-order mode adjacent to the base mode is transited into the Q value of the base mode, and the Q value of the base mode is higher than that prior to transition; and when the Q value of the base-mode is higher than the Q value of the higher-order mode adjacent, to the base mode, the Q value of the higher-order mode adjacent to the base mode is transited into the Q value of the base-mode, and the Q value of the base-mode is lower than that prior to transition;

wherein in four areas formed by a start point and a final point of the K value and the three value Q transition points, the Q value of the base mode and the Q value of the higher-order mode adjacent to the base mode vary along with variation of cavity sizes and dielectric resonant block sizes, and different areas have different requirements when being applied to a filter.

2. The cavity high-Q triple-mode dielectric resonant hollow structure as claimed in claim 1, wherein a nested dielectric resonant block is nested in the hollow chamber; a volume of the nested dielectric resonant block is smaller than or equal to a volume of the hollow chamber; when the volume of the nested dielectric resonant block is smaller than the volume of the hollow chamber, the nested dielectric resonant block is installed in the hollow chamber through the dielectric support frame in a supported manner; the nested dielectric resonant block is of a solid structure or hollow structure; the nested dielectric resonant block of the hollow structure is filled with air or a second nested dielectric resonant block is nested therein, and so on.

3. The high-Q triple-mode cavity dielectric resonant hollow structure as claimed in claim 2, wherein both the hollow chamber and the nested dielectric resonant block take a cube-like shape; when the ratio of the size of the single side of the hollow chamber to the size of a corresponding single side of the nested dielectric resonant block is smaller than or equal to 2, the transited Q value of the base mode remains substantially unchanged; and when the ratio of the single side of the dielectric resonant block to the size of the corresponding single side of the hollow cavity is greater than 2, the transited Q value of the base mode is greatly decreased.

4. The high-Q triple-mode cavity dielectric resonant hollow structure as claimed in claim 1, wherein the cavity and the dielectric resonant block have a same size in X, and Z axes, a degenerate triple mode is formed, and the degenerate triple-mode is coupled with other single cavities to form a bandpass filter;

when differences of sizes, of the cavity and the dielectric resonant block in three directions along the X, Y and Z axes are slightly unequal, an orthogonal-like triple-mode resonance is formed, if an orthogonal-like triple-mode is coupled with other cavities into the bandpass, filter, the sizes are acceptable, and if the orthogonal-like triple-mode, cannot be coupled with other cavities into the bandpass filter, the sizes are unacceptable; and when the differences of the sizes of the cavity and the dielectric resonant block in the three directions along the X, Y and Z axes are greatly different, the degenerate triple-mode or orthogonal-like triple-mode cannot be formed, three modes of different frequencies are formed instead, thus the modes cannot be coupled with other cavities into the pass band filter, and the sizes are unacceptable.

5. The high-Q triple-mode cavity dielectric resonant, hollow structure as claimed in claim 4, wherein the cavity high-Q triple-mode dielectric resonant hollow structure forms the degenerate triple mode in directions along the X, V and Z axes; a tuning frequency of the degenerate triple mode in an X-axis direction is achieved by additionally installing a tuning screw or a tuning disc at a place with concentrated field intensity on one or two faces of the X axis corresponding to the cavity so as to change a distance or change capacitance: a tuning, frequency in a Y-axis direction is achieved by additionally installing a tuning screw or a tuning disc at a place with concentrated field intensity on one or two faces of the Y axis corresponding to the cavity so as to change a distance or change capacitance; and a tuning frequency in Z-axis direction is achieved by additionally installing a tuning screw or a tuning disc at a place with concentrated field intensity on one or two faces of the Z axis corresponding to the cavity so as to change a distance or change capacitance.

6. The high-Q triple-mode cavity dielectric resonant hollow structure, as claimed in claim 4, wherein the high-Q triple-mode cavity dielectric resonant hollow structure forms the degenerate triple mode in directions along the X, Y and Z axes, and a frequency of the degenerate triple mode is adjusted by changing dielectric constants; dielectric constant films of different shapes and thicknesses, are adhered to a surface of the dielectric resonant block, the inner wall of the cavity, an inner wall of the cover plate or a bottom of the tuning screw, and the films are made of a ceramic medium or a ferroelectric material;

the tuning screw or the tuning disc is made of a metal, or the tuning screw or the tuning disc is made of a metal and the metal is electroplated by copper or electroplated by silver, or the tuning disc or the tuning disc is made of a medium, or the tuning screw or the tuning disc is made of a surface metallized medium;

the tuning screw takes the shape of any one of metallic rods, medium rods, metallic discs, medium discs, metallic rods with metallic discs, metallic rods with medium discs, medium discs with metallic discs and medium rods with medium discs.

7. The high-Q triple-mode cavity dielectric resonant hollow structure as claimed in claim 1, wherein the high-Q triple-mode cavity dielectric resonant hollow structure is internally provided with at least two nonparallel arranged coupling devices for changing the orthogonal property of the electromagnetic field of the degenerate triple-mode in the cavity, each coupling device comprises cut corners/chamfers/grooves arranged on edges of the dielectric resonant block, or comprises chamfers/cut corners disposed at inner corners of the cavity, or comprises cut corners and/or holes disposed, on edges of the dielectric resonant block, and chamfers/cut corners beside the edges of the cavity, or comprises cut corners/chamfers/grooves disposed beside the edges of the dielectric resonant block and chamfers/cut corners beside the edges of the cavity, or comprises tapping lines or/pieces arranged on nonparallel planes in the cavity;

the cut corners take a shape of a triangular prism or a cuboid or a sector; after corner cutting, in case of frequency holding, side lengths of the dielectric resonant block are increased, and the Q value is slightly decreased;

depths of the cut corners or holes are of through or partial cut corners/partial hole structures according to expected coupling amounts;

the coupling amounts are affected by sizes of the cut corners/chamfers/holes;

a coupling tuning structure comprises a coupling screw disposed in a direction perpendicular or parallel to the cut corners; the coupling screw is made of a metal, or the coupling screw is made of a metal and the metal is electroplated by copper or electroplated by silver, or the coupling screw is made of a dielectric, or the coupling screw is made of a surface metallized dielectric; and the coupling screw takes a shape of any one of metallic rods, dielectric rods, metallic discs, dielectric discs, metallic rods with metallic discs, metallic rods with dielectric discs, dielectric discs with metallic discs and dielectric rods with dielectric discs.

8. The high-Q triple-mode cavity dielectric resonant hollow structure as claimed in claim 1, wherein the high-Q triple-mode cavity dielectric resonant hollow structure is internally provided with at least two nonparallel arranged coupling devices for changing the orthogonal property of the degenerate triple-mode electromagnetic field in the cavity, each coupling device comprises holes/grooves arranged on an end face of the dielectric resonant block; central lines of the holes or grooves are parallel to edges perpendicular to the end surfaces with the holes or the grooves of the dielectric resonant block;

or the each coupling device comprises chamfers/cut corners arranged at inner corners of the cavity;

or comprises holes/grooves arranged in the end faces of the dielectric resonant block and chamfers/cut corners beside the edges, of the cavity;

or comprises tapping lines or/pieces arranged on nonparallel planes in the cavity;

depths of the holes are of through or partial hole structures according to required coupling amounts;

the coupling amount is affected by the sizes of the holes;

the holes/grooves take a shape of a circle, a rectangle or a polygon, and after the holes/grooves are formed, in case of frequency holding, side lengths of the dielectric resonant block are increased, and the Q value is slightly decreased;

a coupling tuning structure comprises a coupling screw arranged in a direction parallel to the holes; the coupling screw is made of a metal, or the coupling screw is made of a metal and the metal is electroplated by copper or electroplated by silver, or the coupling screw is made of a dielectric, or the coupling screw is made of a surface metallized dielectric; and the coupling screw takes a shape of any one of metallic rods, dielectric rods, metallic discs, dielectric discs, metallic rods with metallic discs, metallic rods with dielectric discs, dielectric discs with metallic discs and dielectric rods with dielectric discs.

9. The high-Q triple-mode cavity dielectric resonant hollow structure as claimed in claim 1, wherein the cavity takes the cube-like shape; to achieve coupling of three modes, on premise that the size of the dielectric resonant block is not changed, cut sides for achieving coupling of the three modes are processed on any two adjacent faces of the cavity; the sizes of the cut sides are relevant to required coupling amounts; coupling of two of the three modes is achieved through the cut sides of the cavity; other coupling is achieved through cut corners of two adjacent sides of the cavity; walls are not broken when corners of the adjacent sides of the cavity are cut; cut corner faces need to be completely sealed with the cavity; a surface of the cavity is, electroplated by copper or electroplated by silver; the cavity is made of a metal or a nonmetal material; and when the cavity is made of the nonmetal material, the inner wall of the cavity needs to be electroplated by a conductive material.

10. The high-Q triple-mode cavity dielectric resonant hollow structure as claimed in claim 1, wherein when the cavity takes the cube-like shape, the dielectric resonant block and the dielectric support frame are installed in any one axial direction of the cavity, and the center of the dielectric resonant block coincides with or approaches to a center of the cavity.

11. The high-Q triple-mode cavity dielectric resonant hollow structure as claimed in claim 1, wherein the dielectric constant of the dielectric support frame is similar to an air dielectric constant; the dielectric support frame is free of influence upon triple-mode resonant frequencies; the dielectric support frame supports with any one single face of the dielectric resonant block, or supports with six faces, or supports with different combinations of two different faces, three faces, four faces and five faces; a number of the dielectric support frame on each face is one or multiple dielectric support frames; and one or multiple support frames are installed on different faces according to demands.

12. The high-Q triple-mode cavity dielectric resonant hollow structure as claimed in claim 11, wherein a single face support combination supports any one face of the dielectric resonant block, and particularly a bottom surface or bearing surface in a vertical direction;

a support combination of two faces comprises parallel faces such as upper and lower faces, front and rear faces and left and right faces, and also comprises nonparallel faces such as upper and front faces, upper and rear faces, upper and left faces and upper and right faces;

a support combination of three faces comprises three faces perpendicular to one another, or two parallel faces and one nonparallel face;

a support combination of four faces comprises two pairs, of parallel faces or a pair of parallel faces and, two another nonparallel faces;

a support combination of five faces comprises support structures on other faces except any one face of a front face/a rear face/a left face/a right face/an upper face/a lower face; and a support combination of six faces comprises support structures on all faces of a front face/a rear face/a left face/a right face/an up face/a down face.

13. The high-Q triple-mode cavity dielectric resonant hollow structure as claimed in claim 1, wherein the dielectric constant of the dielectric support frame is greater than an air dielectric constant and smaller than the dielectric constant of the dielectric resonant block; to hold original triple-mode frequencies, a size corresponding to an axial direction of the dielectric resonant block of the dielectric support frame is slightly reduced; the dielectric support frame supports with any one single face of the dielectric resonant block, or supports with six faces, or supports with different combinations of two different faces, three faces, four faces and five faces; a face without the support frame is an air face; the air face is arbitrarily combined with the dielectric support frame; a number of the dielectric support frame on each face is one or multiple, or the dielectric support frame on each face is a complex dielectric constant support frame composed of multiple layers of different dielectric constant dielectric materials; single-layer and multi-layer dielectric material support frames are arbitrarily combined with cube-like dielectric blocks; one or multiple dielectric support frames is installed on different faces according to demands; on faces with the dielectric support frames, to hold the triple-mode frequencies and the value, the size corresponding to the axial direction of the dielectric resonant block of the dielectric support frame is slightly reduced.

14. The high-Q triple-mode cavity dielectric resonant hollow structure as claimed in claim 13, wherein a single face support combination supports any one face of the dielectric resonant block, and particularly a bottom surface or bearing surface in a vertical direction;

a support combination of two faces comprises parallel faces such as upper and lower faces, front and rear faces and left and right faces, and also comprises nonparallel faces such as upper and front faces, upper and rear faces, upper and left faces and upper and right faces;

a support combination of three faces comprises three faces perpendicular to one another, or two parallel faces and one nonparallel face;

a support combination of four faces comprises two pairs of parallel faces or a pair of parallel faces and two another nonparallel faces;

a support combination of five faces comprises support structures on other faces except any one face of a front face/a rear face/a left face/a right face/an upper face/a lower face; and a support combination of six faces comprises support structures on all faces of a front face/a rear face/a left face/a, right face/an up face/a down face.

15. The high-Q triple-mode cavity dielectric resonant hollow structure as claimed in claim 1, wherein a surface area of the dielectric support frame is smaller than or equal to a surface area of the dielectric resonant block; the dielectric support frame is a cylinder, a cube and a cuboid;

the dielectric support frame is of a solid structure or hollow structure; the dielectric support frame of the hollow structure comprises a single hole or multiple holes; each hole takes a shape of a circle, a square, a polygon and an arc; and the dielectric support frame is made of air, plastics and ceramics.

16. The high-Q triple-mode cavity dielectric resonant hollow structure as claimed in claim 1, wherein the dielectric support frame and the dielectric resonant block are connected in a mode of crimping, adhesion or sintering; and the dielectric support frame and the inner wall of the cavity are connected in a mode of adhesion, crimping, welding, sintering or screw fixation.

17. The high-Q triple-mode cavity dielectric resonant hollow structure as claimed in claim 1, wherein a radio frequency channel formed by coupling of radio frequency signals in directions of the X, Y and Z axes of the triple mode causes loss and generates heat, the dielectric resonant block is sufficiently connected with the inner wall of the cavity through the dielectric support frame, and thus the heat is conducted into the cavity for heat dissipation.

18. The high-Q triple-mode cavity dielectric resonant hollow structure as claimed in claim 1, wherein a frequency temperature coefficient of the dielectric resonant block is controlled by adjusting proportions of dielectric materials, and is compensated according to frequency deviation variation of a filter at different temperatures.

19. The high-Q triple-mode cavity dielectric resonant hollow structure as claimed in claim 18, wherein the dielectric resonant block has a single dielectric constant or composite dielectric constants; the dielectric resonant block with the composite dielectric constants is formed by at least two materials of different dielectric constants; the at least two materials of different dielectric constants are combined up and down, left and right, asymmetrically or in a nested mode; when the at least two materials, of different dielectric constants are nested in the dielectric resonant block, one or more layers are nested; the dielectric resonant block with the composite dielectric constants needs to comply with variation rules of the 0 value transition points; when the dielectric resonant block is subjected to cut side coupling among triple modes, to hold a required frequency, corresponding side lengths of two faces adjacent to the cut sides are adjusted; the dielectric resonant block is made of a ceramic or dielectric material; and dielectric sheets of different thicknesses and different dielectric constants are added on a surface of the dielectric resonant block.

20. A filter with a cavity high-Q triple-mode dielectric resonant hollow structure, comprising a cavity, a cover plate and an input/output structure, wherein the cavity is internally provided with at least one high-Q triple-mode cavity dielectric resonant hollow structure as claimed in claim 1;

the cavity high-Q triple-mode dielectric resonant hollow structure is combined with a single-mode resonant structure, a dual-mode resonant structure and a triple-mode, resonant structure in different modes to form filters of different volumes;

a coupling of any two resonant cavities formed by permutation and combination of the cavity high-Q triple-mode dielectric resonant hollow structure and any one of the single-mode resonant structure, the dual-mode resonant structure and the triple-mode resonant structure is achieved through a size of a window between the two resonant cavities necessarily when resonant rods in the two resonant cavities are parallel, and the size of the window is determined according to a coupling amount; and the filter has function properties of band pass, band stop, high pass, low pass and a duplexer, a multiplexer and a combiner formed thereby.

21. The filter with a cavity high-Q triple-mode dielectric resonant hollow structure as claimed in claim 20, wherein a value of the transition point 1 and a value of the transition point 2 both vary according to different base-mode resonant frequencies of the dielectric resonant block, dielectric constants of the dielectric resonant block and dielectric constants of the support frame.

22. The filter with a cavity high-Q triple-mode dielectric resonant hollow structure as claimed in claim 20, wherein when the base-mode resonant frequency of the dielectric resonant block after transition remains unchanged, the Q value of the triple-mode cavity resonant structure is relevant to the K value, the dielectric constant of the dielectric resonant block and the size of the dielectric resonant block.

23. The filter with a cavity high-Q triple-mode dielectric resonant hollow structure as claimed in claim 20, wherein when the K value is increased to the maximum from 1.0, the K value has three Q value transition points within a variation range, each Q value transition point enables the Q value of the base mode and the Q value of the higher-order mode adjacent to the base mode to be transited; when the Q value of the base mode is lower than the Q value of the higher-order mode adjacent to the base mode, the Q value of the higher-order mode adjacent to the base mode is transited into the value of the base mode, and the Q value of the base mode is higher than that prior to transition and when the Q value of the base-mode is higher than the value of the higher-order mode adjacent to the base mode, the Q value of the higher-order mode adjacent to the base mode is transited into the Q value of the base-mode, and the Q value of the base-mode is lower than that prior to transition.

24. The filter with a cavity high-Q triple-mode dielectric resonant hollow structure as claimed in claim 23, wherein in four areas formed by a start point and a final point of the K value and the three value Q transition points, the Q value of the base mode and the Q value of the higher-order mode adjacent to the base mode vary along with variation of cavity sizes and dielectric resonant rod sizes, and different areas have different requirements when being applied to a filter.

25. The filter with a cavity high-Q triple-mode dielectric resonant hollow structure as claimed in claim 20, wherein the hollow chamber is of a cube-like shape; when a ratio of size of the single side of the dielectric resonant block to a size of a corresponding single side of the hollow chamber is greater than 6, the transited Q value of the base mode remains generally unchanged, and when the ratio of the single side of the dielectric resonant block to the size of the corresponding single side of the hollow chamber is smaller than 6, the transited 0 value of the base mode is greatly decreased.

26. The filter with a cavity high-Q triple-mode dielectric resonant hollow structure as claimed in claim 20, wherein the cavity and the dielectric resonant block have a same size in X, Y and Z axes, a degenerate triple mode is formed, and the degenerate triple-mode is coupled with other single cavities to form a bandpass filter;

when differences of sizes of the cavity and the dielectric resonant block in three directions along the X, Y and Z axes are slightly unequal, an orthogonal-like triple-mode resonance is formed, if an orthogonal-like triple-mode is coupled with other cavities into the bandpass filter, the sizes are acceptable, and if the orthogonal-like triple-mode cannot be coupled with other cavities into the bandpass filter, the sizes are unacceptable; and when the differences of the sizes of the cavity and the dielectric resonant block in the three directions along the X, Y and Z axes are greatly different, the degenerate triple-mode or orthogonal-like triple-mode cannot be formed, three modes of different frequencies are formed instead, thus the modes cannot be coupled with other cavities into the pass band filter, and the sizes are unacceptable.

27. The filter with a cavity high-Q triple-mode dielectric resonant hollow structure as claimed in claim 26, wherein the cavity high-Q triple-mode dielectric resonant hollow structure forms the degenerate triple mode in directions along the X, Y and Z axes; a tuning frequency of the degenerate triple mode in an X-axis direction is achieved by additionally installing a tuning screw or a tuning disc at a place with concentrated field intensity on one or two faces of the X axis corresponding to the cavity so as to change a distance or change capacitance; a tuning frequency in a Y-axis direction is achieved by additionally installing a tuning screw or a tuning disc at a place with concentrated field intensity on one or two faces of the Y axis corresponding to the cavity so as to change a distance or change capacitance; and a tuning frequency in Z-axis direction is achieved by additionally installing a tuning screw or a tuning disc at a place with concentrated field intensity on one or two faces of the Z axis corresponding to the cavity so as to change a distance or change capacitance.

28. The filter with a cavity high-Q triple-mode dielectric resonant hollow structure as claimed in claim 26, wherein the high-Q triple-mode cavity dielectric resonant hollow structure forms the degenerate triple mode in directions along the X, Y and Z axes, and a frequency of the degenerate triple mode is adjusted by changing dielectric constants; dielectric constant films of different shapes and thicknesses are adhered to a surface of the dielectric resonant block, the inner wall of the cavity, an inner wall of the cover plate or a bottom of the tuning screw, and the films are made of a ceramic dielectric or a ferroelectric material;

the tuning screw or the tuning disc, is made of a metal, or the tuning screw or the tuning disc is made of a metal and the metal is electroplated by copper or electroplated by silver, or the tuning disc or the tuning disc is made of a dielectric, or the tuning screw or the tuning disc is made of a surface metallized dielectric;

the tuning screw takes the shape of any one of metallic rods, dielectric rods, metallic discs, dielectric discs, metallic rods with metallic discs, metallic rods with dielectric discs, dielectric discs with metallic discs and dielectric rods with dielectric discs.

29. The filter with a cavity high-Q triple-mode dielectric resonant hollow structure as claimed in claim 20, wherein the high-Q triple-mode cavity dielectric resonant hollow structure is internally provided with at least two nonparallel arranged coupling devices for changing the orthogonal property of the electromagnetic field of the degenerate triple-mode in the cavity, each coupling device comprises, cut corners/chamfers/grooves arranged on edges of the dielectric resonant block, or comprises chamfers/cut corners disposed at inner corners of the cavity, or comprises cut corners and/or holes disposed on edges of the dielectric resonant block, and chamfers/cut corners beside the edges of the cavity, or comprises cut corners/chamfers/grooves disposed beside the edges of the dielectric resonant block and chamfers/cut corners beside the edges of the cavity, or comprises tapping lines or/pieces arranged on nonparallel planes in the cavity;

the cut corners take a shape of a triangular prism or a cuboid or a sector: after corner cutting, in case of frequency holding, side lengths of the dielectric resonant block are increased, and the 0 value is slightly decreased;

depths of the cut corners or holes are of through or partial cut corners/partial hole structures according to expected coupling amounts;

the coupling amounts are affected by sizes of the cut corners/chamfers/holes;

a coupling tuning structure comprises a coupling screw disposed in a direction perpendicular or parallel to the cut corners; the coupling screw is made of a metal, or the coupling screw is made of a metal and the metal is, electroplated by copper or electroplated by silver, or the coupling screw is made of a dielectric, or the coupling screw is made of a surface metallized dielectric; and the coupling screw takes a shape of any one of metallic rods, dielectric rods, metallic discs, dielectric discs, metallic rods with metallic discs, metallic rods with dielectric discs, dielectric discs with metallic discs and dielectric rods with dielectric discs.

30. The filter with a cavity high-Q triple-mode dielectric resonant hollow structure as claimed in claim 20, wherein the high-Q triple-mode cavity dielectric resonant hollow structure is internally provided with at least two nonparallel arranged coupling devices for changing the orthogonal property of the degenerate triple-mode electromagnetic field in the cavity, each coupling device comprises holes/grooves arranged on an end face of the dielectric resonant block; central lines of the holes or grooves are parallel to edges perpendicular to the end surfaces with the holes or the grooves of the dielectric resonant block;

or the each coupling device comprises chamfers/cut corners arranged at inner corners of the cavity;

or comprises holes/grooves arranged in the end faces of the dielectric resonant block and chamfers/cut corners beside the edges of the cavity;

or comprises tapping lines or/pieces arranged on nonparallel planes in the cavity;

depths of the holes are of through or partial hole structures according to required coupling amounts;

the coupling amount is affected by the sizes of the holes;

the holes/grooves take a shape of a circle, a rectangle or a polygon, and after the holes/grooves are formed, in case of frequency holding, side lengths of the dielectric resonant block are increased, and the Q value is slightly decreased;

a coupling tuning structure comprises a coupling screw arranged in a direction parallel to the holes; the coupling screw is made of a metal, or the coupling screw is made of a metal and the metal is electroplated by copper or electroplated by silver, or the coupling screw is made of a dielectric, or the coupling screw is made of a surface metallized dielectric; and the coupling screw takes a shape of any one of metallic rods, dielectric rods, metallic discs, dielectric discs, metallic rods with metallic discs, metallic rods with dielectric discs, dielectric discs with metallic discs and dielectric rods with dielectric discs.

31. The filter with a cavity high-Q triple-mode dielectric resonant hollow structure as claimed in claim 20, wherein the cavity takes the cube-like shape; to achieve coupling of three modes, on premise that the size of the dielectric resonant block is not changed, cut sides for achieving coupling of the three modes are processed on any two adjacent faces of the cavity; the sizes of the cut sides are relevant to required coupling amounts; coupling of two of the three modes is achieved through the cut sides of the cavity; other coupling is achieved through cut corners of two adjacent sides of the cavity; walls are not broken when corners of the adjacent sides of the cavity are cut; cut corner faces need to be completely sealed with the cavity; a surface of the cavity is electroplated by copper or electroplated by silver; the cavity is made of a metal or a nonmetal material; and when the cavity is made of the nonmetal material, the inner wall of the cavity needs to be electroplated by a conductive material.

32. The filter with a cavity high-Q triple-mode dielectric resonant hollow structure as claimed in claim 20, wherein when the cavity takes the cube-like shape, the dielectric resonant block and the dielectric support frame are installed in any one axial direction of the cavity, and the center of the dielectric resonant block coincides with or approaches to a center of the cavity.

33. The filter with a cavity high-Q triple-mode dielectric resonant hollow structure as claimed in claim 20, wherein the dielectric constant of the dielectric support frame is similar to an air dielectric constant; the dielectric support frame is free of influence upon triple-mode resonant frequencies; the dielectric support frame supports with any one single face of the dielectric resonant block, or supports with six faces, or supports with different combinations of two different faces, three faces, four faces and five faces; a number of the dielectric support frame on each face is one or multiple dielectric support frames; and one or multiple support frames are installed on different faces according to demands.

34. The filter with a cavity high-Q triple-mode dielectric resonant hollow structure as claimed in claim 20, wherein the dielectric constant of the dielectric support frame is greater than an air dielectric constant and smaller than the dielectric constant of the dielectric resonant block; to hold original triple-mode frequencies, a size corresponding to an axial direction of the dielectric resonant block of the dielectric support frame is slightly reduced; the dielectric support frame supports with any one single face of the dielectric resonant block, or supports with six faces, or supports with different combinations of two different faces, three faces, four faces and five faces; a face without the support frame is an air face; the air face is arbitrarily combined with the dielectric support frame; a number of the dielectric support frame on each face is one or multiple, or the dielectric support frame on each face is a complex dielectric constant support frame composed of multiple layers of different dielectric constant dielectric materials; single-layer and multi-layer dielectric material support frames are arbitrarily combined with cube-like dielectric blocks; one or multiple dielectric support frames is installed on different faces according to demands, on faces with the dielectric support frames, to hold, the triple-mode frequencies and the Q value, the size corresponding to the axial direction of the dielectric resonant block of the dielectric support frame is slightly reduced.

35. The filter with a cavity high-Q triple-mode dielectric resonant hollow structure as claimed in claim 20, wherein a surface area of the dielectric support frame is smaller than or equal to a surface area of the dielectric resonant block; the dielectric support frame is a cylinder, a cube and a cuboid;

the dielectric support frame is of a solid structure or hollow structure; the dielectric support frame of the hollow structure comprises a single hole or multiple holes; each hole takes a shape of a circle, a square, a polygon and an arc; and the dielectric support frame is made of air, plastics, ceramics and dielectrics.

36. The filter with a cavity high-Q triple-mode dielectric resonant hollow structure as claimed in claim 20, wherein the dielectric support frame and the dielectric resonant block are connected in a mode of crimping, adhesion or sintering; and the dielectric support frame and the inner wall of the cavity are connected in a mode of adhesion, crimping, welding, sintering or screw fixation.

37. The filter with a cavity high-Q triple-mode dielectric resonant hollow structure as, claimed in claim 20, wherein a radio frequency channel formed by coupling of radio frequency signals in directions of the X, Y and Z axes of the triple mode causes loss and generates heat, the dielectric resonant block is sufficiently connected with the inner wall of the cavity through the dielectric support frame, and thus the heat is conducted into the cavity for heat dissipation.

38. The filter with a cavity high-Q triple-mode dielectric resonant hollow structure as claimed in claim 20, wherein a frequency temperature coefficient of the dielectric resonant block is controlled by adjusting proportions of dielectric materials, and is compensated according to frequency deviation variation of a filter at different temperatures.

39. The filter with a cavity high-Q triple-mode dielectric resonant hollow structure as claimed in claim 38, wherein the dielectric resonant block has a single dielectric constant or composite dielectric constants; the dielectric resonant block with the composite dielectric constants is formed by at least two materials of different dielectric constants; the at least two materials of different dielectric constants are combined up and down, left and right, asymmetrically or in a nested mode; when the at least two materials of different dielectric constants are nested in the dielectric resonant block, one or more layers are nested; the dielectric resonant block with the composite dielectric constants needs to comply with variation rules of the Q value transition points; when the dielectric resonant block is subjected to cut side coupling among triple modes, to hold a required frequency, corresponding side lengths of two aces adjacent to the cut sides are adjusted; the dielectric resonant block is made of a ceramic or dielectric material; and dielectric sheets of different thicknesses and different dielectric constants are added on a surface of the dielectric resonant block.

* * * * *